US012674469B2

(12) United States Patent
Chapa et al.

(10) Patent No.: US 12,674,469 B2
(45) Date of Patent: Jul. 7, 2026

(54) SPIN-RESISTANT DIFFUSER FOR ELECTRIC SUBMERSIBLE PUMP

(71) Applicant: Halliburton Energy Services, Inc., Houston, TX (US)

(72) Inventors: Andres Chapa, Tulsa, OK (US); Joshua Wayne Webster, Tulsa, OK (US); David McManus, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/816,098

(22) Filed: Aug. 27, 2024

(65) Prior Publication Data

US 2026/0063142 A1 Mar. 5, 2026

(51) Int. Cl.

| | |
|---|---|
| ***F04D 29/44*** | (2006.01) |
| ***E21B 43/12*** | (2006.01) |
| ***F04D 1/06*** | (2006.01) |

(52) U.S. Cl.
CPC ..... *F04D 29/445* (2013.01); *E21B 43/128* (2013.01); *F04D 1/06* (2013.01)

(58) Field of Classification Search
CPC ..... F04D 29/445; F04D 29/44; F04D 1/06; E21B 43/128
See application file for complete search history.

(56) References Cited

U.S. PATENT DOCUMENTS

| | | | | |
|---|---|---|---|---|
| 3,825,368 | A * | 7/1974 | Benjamin | F04D 17/122 415/214.1 |
| 5,722,812 | A * | 3/1998 | Knox | F04D 29/0413 415/199.1 |
| 6,454,010 | B1 * | 9/2002 | Thomas | E21B 43/129 417/423.6 |
| 8,043,051 | B2 | 10/2011 | Brunner | |
| 11,174,872 | B2 * | 11/2021 | Hill | F04D 29/62 |
| 11,339,789 | B2 | 5/2022 | Webster et al. | |
| 11,377,939 | B1 | 7/2022 | Ye et al. | |
| 11,821,431 | B2 | 11/2023 | Ye et al. | |

(Continued)

OTHER PUBLICATIONS

Liang, Wei-Cheng et al., "Tripping Device of Screw Pump," CPO, CN 204553215, Aug. 12, 2015 (Year: 2015).*

(Continued)

*Primary Examiner* — Nathaniel E Wiehe
*Assistant Examiner* — Joshua R Beebe
(74) *Attorney, Agent, or Firm* — Conley Rose, P.C.; Rodney B. Carroll

(57) ABSTRACT

A diffuser stack for a centrifugal pump includes a first diffuser including a first rim having a first inner circumferential surface, a first outer circumferential surface, and protrusions extending radially inward from the first inner circumferential surface. The diffuser stack further includes a second diffuser including a second rim having a second inner circumferential surface and a second outer circumferential surface. Recesses are formed in the second diffuser. The recesses extend radially inward from the second outer circumferential surface. The second diffuser is configured to engage the first diffuser such that the second outer circumferential surface engages the first inner circumferential surface and the protrusions engage the recesses.

27 Claims, 18 Drawing Sheets

(56) References Cited

U.S. PATENT DOCUMENTS

| | | | | |
|---|---|---|---|---|
| 2008/0292454 | A1 | 11/2008 | Brunner | |
| 2009/0095436 | A1* | 4/2009 | Pessin | F04D 29/026 164/95 |
| 2013/0017075 | A1 | 1/2013 | Orban et al. | |
| 2015/0147168 | A1* | 5/2015 | Nowitzki | F04D 1/063 415/207 |
| 2018/0291917 | A1* | 10/2018 | Webster | F04D 13/10 |
| 2019/0285071 | A1* | 9/2019 | Webster | F04D 29/628 |
| 2020/0263703 | A1 | 8/2020 | Hill et al. | |
| 2021/0048029 | A1* | 2/2021 | Ye | F04D 29/0473 |
| 2021/0140436 | A1* | 5/2021 | Ye | F04D 29/0416 |

OTHER PUBLICATIONS

Sun, De-xu, et al., "A Rotary Oil Drain Anchor under Pump and Use Method Thereof" CPO, CN 120159349, Jun. 17, 2025 (Year: 2025).*

Chen et al., "A High-efficient Special Cooling Device for Hydraulic Pump Station," CPO, CN 214998609, Dec. 3, 2021 (Year: 2021).*

Foreign Communication from Related Application - International Search Report and Written Opinion of the International Searching Authority, International Application No. PCT/US2024/048360 dated May 21, 2025, 16 pages.

* cited by examiner

SPIN-RESISTANT DIFFUSER FOR ELECTRIC SUBMERSIBLE PUMP

CROSS-REFERENCE TO RELATED APPLICATIONS

None.

STATEMENT REGARDING FEDERALLY SPONSORED RESEARCH OR DEVELOPMENT

Not applicable.

BACKGROUND

A centrifugal pump is a mechanical device that uses rotational energy from an impeller to move fluid through a system. When a multi-stage centrifugal pump is operating, stationary diffusers are subjected to rotational forces that may cause the diffusers to spin if inadequate compression is applied to the diffuser stack during assembly or if the pump is subjected to high enough temperatures that compression is lost due to thermal expansion of the pump housing. Spinning diffusers in a pump may result in poor pump performance and pre-mature pump failures due to the heat generated by these components rotating. The diffusers of the present disclosure may address one or more of these issues.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIG. 3A1 is another perspective view of the diffuser of FIG. 3A;

FIG. 3B1 is another perspective view of the diffuser of FIG. 3B.

FIG. 4A1 is another perspective view of the diffuser of FIG. 4A;

FIG. 4B1 is another perspective view of the diffuser of FIG. 4B;

FIG. 5A1 is another perspective view of the diffuser of FIG. 5A;

FIG. 5B1 is another perspective view of the diffuser of FIG. 5B;

DETAILED DESCRIPTION

Figure 1A:
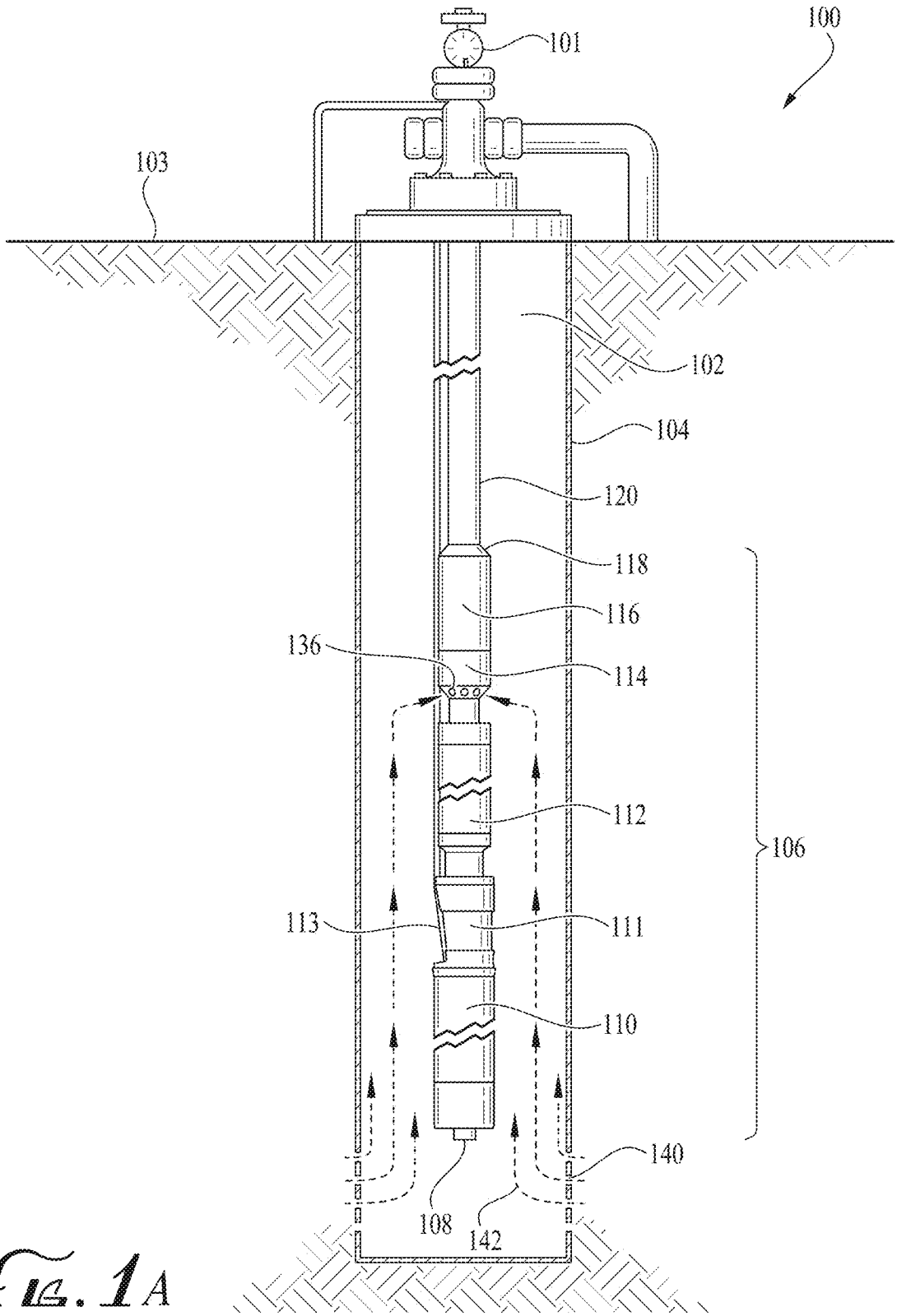
FIG. 1A is an illustration of a completion string disposed in a wellbore according to an embodiment of the present disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid, for example relative to flow of well fluid in the well. As used herein, orientation terms "upstream," "downstream," are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid.

Conventional diffusers in centrifugal pumps have been known to spin and wear through the pump housing and cause pump failures. The system of the present disclosure may utilize anti-rotation cast features (e.g., protrusions) on ends of mating diffusers for an ESP that provide a mechanical lock and prevent relative rotation between the diffusers. This can improve pump performance and prevent pre-mature pump failure. The method of making the system makes use of casting and machining techniques to allow the anti-rotation features to be formed while still achieving tight tolerances in specific locations to enable a tight fit and thus centralization and alignment of the mated diffusers.

The method may include casting recesses in the outer diameter of a male register of a diffuser and casting protrusions in the inner diameter of a female register of a diffuser that match the profile of the recesses. The protrusions along the inner diameter of the female register may interfere with the recesses of the male register, providing a mechanical lock and preventing relative rotation between the adjacent diffusers. The anti-rotation features extend radially from the overlapping male and female registers. The geometry of these anti-rotation features may allow for machine-to-cast surface mates on both the male and female registers with no milling operations required. The interlocking diffusers may present the advantage of allowing an electric submersible pump (ESP) system to operate in high temperature wells where compression in the pump diffuser stack can be lost. It can provide additional protection for the pump if inadequate compression is applied to the diffuser stack during assembly.

In some embodiments, the male register of the spin-resistant diffuser may have a number of casted recesses extending radially inward into the outer circumference of male register. The female register of the diffuser may have a number of cast features extending radially inward from the inner circumference of female register, matching the profile of the male register recesses. The female register also may also have cast recesses to ensure the outer diameter of the male register will nest inside female register without interfering on the cast surfaces. This may be done because some areas cannot be machined with a lathe like the rest of the diffuser dimensions. The casted recess may be cast with a nominal diameter larger than the female register inner diameter to compensate for the cast tolerance and allow a clearance between the female register and the male register outer diameter.

The cast recesses may have the general profile of a right trapezoid where the inner and outer sides of the trapezoid have a circular arc that is concentric with the rest of the cylindrical diffuser, and where one end has a straight side while the other end has a curved taper. The diffusers may be stacked axially on top of one another. The male register of an end of a diffuser may fit inside the female register of an end of an adjacent diffuser. When adjacent diffusers are subjected to a differential torque, the radial interference (e.g., the difference between the outer diameter of the male register and the inner diameter of the cast feature extending radially inward from the inner circumference of female register). The outer diameter of the male register and the inner diameter of the cast feature along the inner circumference of the female register may create a mechanical lock that prevents relative rotation between the diffusers.

The cast recesses and features may have different shapes. For example, cast recesses and features may have the general profile of a curved rectangular prism where the curved long edges may have a circular arc that is concentric with the rest of the cylindrical diffuser and where the imaginary line created along the short edges intersects the center point of the diffuser. The cast recesses and features may alternatively have the general profile of a trapezoid where the inner and outer sides of the trapezoid have a circular arc that is concentric with the rest of the cylindrical diffuser and where the ends are equal in angle with respect to the male or female register and length. A mechanical lock that prevents relative rotation between adjacent diffusers may be caused by radial interference between the outer diameter of the male register and the inner diameter of the cast feature along the inner circumference of the female register. The diffuser of the present disclosure may be used in an electric submersible pump. The electric submersible pump may be used at a well site environment, a pipeline, or any other suitable location. The diffuser of the present disclosure may also be used in a horizontal pumping system (HPS).

Referring to FIG. 1A an exemplary well site environment 100 is shown. The well site environment 100 may include a wellbore 102 that is at least partially cased with casing 104. The wellbore 102 may be substantially vertical, but the electric submersible pump (ESP) 106 described herein also may be used in a wellbore 102 that has a deviated or horizontal portion. The well site environment 100 may be at an on-shore location or at an off-shore location. In some embodiments, the ESP 106 may include a sensor package 108, an electric motor 110, a motor head 111 that couples the electric motor 110 to a seal unit 112, a fluid intake 114 having inlet ports 136, and/or a centrifugal pump assembly 116. The centrifugal pump assembly 116 may include centrifugal pump stages.

In some embodiments, the electric motor 110 may be replaced by a hydraulic turbine, a pneumatic turbine, a hydraulic motor, or an air motor. In some embodiments, the ESP 106 may further include a gas separator assembly that may be located between the fluid intake 114 and the centrifugal pump assembly 116. In some embodiments, the fluid intake 114 may be integrated into a downhole end of the gas separator. In some embodiments, the fluid intake 114 may be integrated into a downhole end of the centrifugal pump assembly 116.

The centrifugal pump assembly 116 may be coupled to a production tubing 120 via a connector 118. An electric cable 113 may attach to the electric motor 110 and extend to the surface 103 to connect to an electric power source. In some embodiments where the electric motor 110 is replaced by a hydraulic turbine or a hydraulic motor, the electric cable 113 may be replaced by a hydraulic power supply line. In some embodiments where the electric motor 110 is replaced by a pneumatic turbine or an air motor, the electric cable 113 may be replaced by a pneumatic power supply line. The casing 104 and/or wellbore 102 may have perforations 140 that allow well fluid 142 to pass from the subterranean formation through the perforations 140 and into the wellbore 102.

In some embodiments, the ESP 106 may have a bottom-intake design in which the fluid intake 114 may be located at the downhole end of the ESP 106, the centrifugal pump assembly 116 may be located uphole of the fluid intake 114, the motor 110 may be located uphole of the centrifugal pump assembly 116, and/or the seal section 112 may be located uphole of the motor 110. For example, in a through-tubing-conveyed completion, the order of placement of components of the ESP 106 may be altered in various ways, for example with the fluid intake located at the downhole end of the ESP 106, the centrifugal pump assembly 116 located uphole of the fluid intake 114, the seal section 112 located uphole of the centrifugal pump assembly 116, and the motor 110 located uphole of the seal section 112.

The well fluid 142 may flow uphole in the wellbore 102 towards the ESP 106, in the inlet ports 136, and into the fluid intake 114. The well fluid 142 may comprise a liquid phase fluid, or the well fluid 142 may comprise a gas phase fluid mixed with a liquid phase fluid. Under normal operating conditions (e.g., well fluid 142 is flowing out of the perforations 140, the ESP 106 is energized by electric power, and the electric motor 110 is turning), the well fluid 142 may enter the inlet ports 136 of the fluid intake 114 and flow into the centrifugal pump assembly 116. The centrifugal pump assembly 116 may cause the fluid to flow through the connector 118 and up the production tubing 120 to a wellhead 101 at the surface 103. The centrifugal pump assembly 116 may provide pumping pressure or pump head to lift the well fluid 142 to the surface. The well fluid 142 may comprise hydrocarbons such as crude oil and/or natural gas. The well fluid 142 may comprise water. In a geothermal application, the well fluid 142 may comprise hot water.

Figure 1B:
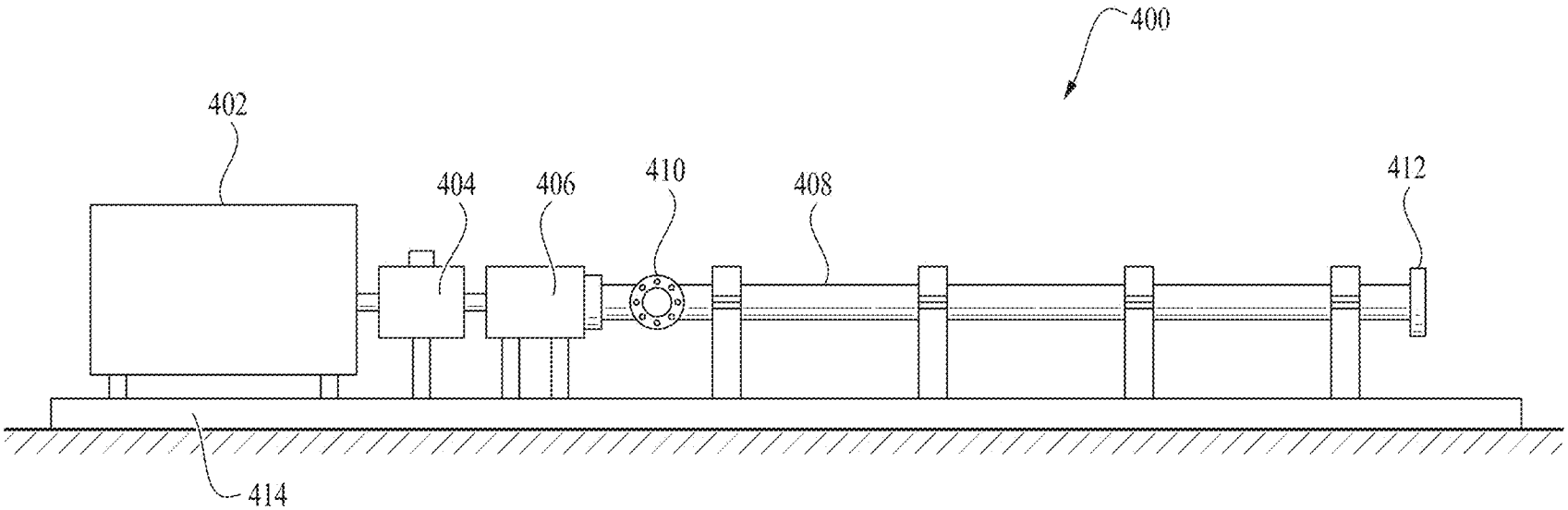
FIG. 1B is an illustration of a horizontal pump system (HPS) according to an embodiment.

Referring to FIG. 1B, an exemplary horizontal pumping system (HPS) 400 is shown. In some embodiments, the HPS 400 comprises a motor 402, a rotational coupling 404, a mechanical seal 406, and/or a centrifugal pump assembly 408. In some embodiments, a fluid inlet 410 is integrated into a first end of the centrifugal pump assembly 408 and/or a fluid outlet 412 is integrated into a second end of the centrifugal pump assembly 408. The motor 402, the rotational coupling 404, the mechanical seal 406, and/or the centrifugal pump assembly 408 may be mounted on a skid 414 for easy transportation to a location on a truck. The skid 414 may be placed on the ground at the location. The centrifugal pump assembly 408 may be the centrifugal pump assembly 116 described above with reference to FIG. 1A, may contain and/or include the centrifugal pump assembly 116, and/or may have similar components as the centrifugal pump assembly 116.

The motor 402 may be an electric motor, a hydraulic turbine, or an air turbine. When the motor 402 turns, the drive shaft of the centrifugal pump assembly 408 may turn, thereby turning the impellers of the centrifugal pump assembly 408. The torque provided by the motor 402 may be transferred via the rotational coupling 404 to the drive shaft of the centrifugal pump assembly 408.

The HPS 400 may be deployed for use in a variety of different surface operations. The HPS 400 can be used as a crude oil pipeline pressure and/or flow booster. The HPS 400 can be used in a mine dewatering operation (e.g., removing water from a mine). The HPS 400 can be used in geothermal energy applications, for example, to pump geothermal water from a wellhead through a pipe to an end-use or energy conversion facility. The HPS 400 can be used in carbon sequestration operations. The HPS 400 can be used in salt water disposal operations, for example receiving salt water from a wellbore and pumping the salt water under pressure down into a disposal well. The HPS 400 can be used in desalinization operations. The HPS 400 may comprise the same or similar structure as the centrifugal pump assembly 116.

Figure 2:
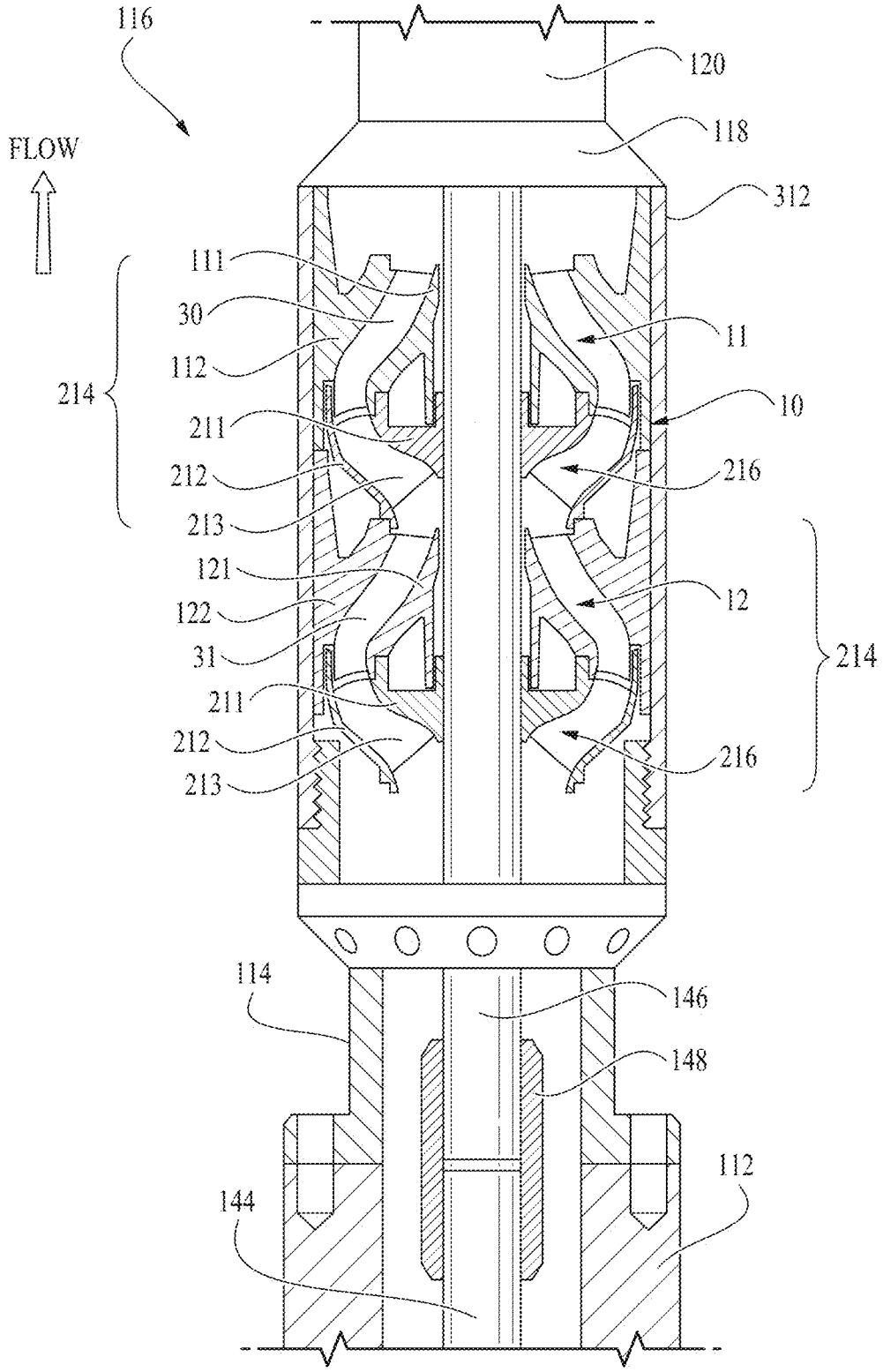
FIG. 2 is a cross-sectional side view of an electric submersible pump (ESP) according to an embodiment.

Referring to FIG. 2, an exemplary centrifugal pump assembly 116 is shown. The centrifugal pump assembly 116 may include pump stages 214 enclosed within a housing 312. For ease of illustration, two pump stages 214 are illustrated in FIG. 2, however, any number of pump stages 214 may be used. For example, one, three, four, five, six, seven, eight, nine, ten, eleven, twelve, 20, 30, 40, 50, 100, 150, 200, or more pump stages 214 may be used. One pump stage 214 may include an impeller 216 and a diffuser 11. Another pump stage 214 may include an impeller 216 and a diffuser 12. The diffuser 11 may be identical to the diffuser 12. The diffuser 11 and the diffuser 12 may form a diffuser stack 10, which may enclose an impeller 216. The diffusers 11, 12 in the stack may be attached to each other by mating rims. Each of the diffusers 11, 12 may have a protrusion on one end and recesses on the opposing end. The protrusions may be inserted into the recesses so that adjacent diffusers mate rim-to-rim. The structure of the rims, protrusions, and recesses is described in more detail herein.

A drive shaft 144 of the seal section 112 may be coupled to a drive shaft of the electric motor 110 and receive rotational power from the drive shaft of the electric motor 110. An uphole end of the drive shaft 144 of the seal section 112 may be coupled via a coupling shell 148 to a downhole end of a drive shaft 146 of the centrifugal pump assembly 116. The impellers 216 may be coupled to the drive shaft 146 (e.g., via a key inserted into keyways defined in the drive shaft and in the inside of the impeller 216), and/or the diffuser stack 10 may be retained by the housing 312. In some embodiments, the pump stages 214 may be disposed uphole with respect to the seal section 112.

The diffuser stack 10 may be engaged with an impeller 216 (e.g., by contact between horizontal bearing surfaces). The diffuser stack 10 includes multiple diffusers, such as a first diffuser 11 and a second diffuser 12. The first diffuser 11 component may engage the second diffuser 12. The first diffuser 11 may include a first hub 111, a first shroud 112, and first vanes 30 connecting the first hub 111 to the first shroud 112. The second diffuser 12 may include a second hub 121, a second shroud 122, and second vanes 31 connecting the second hub 121 to the second shroud 122. The impeller 216 may include an impeller hub 211, an impeller shroud 212, and impeller vanes 213 connecting the impeller hub 211 to the impeller shroud 212.

In some embodiments, the centrifugal pump assembly 116 comprises bearings. For example, each stage 214 may comprise a bearing. The diffusers 11, 12 may stack with each other to prevent relative rotation. The impeller 216 may be disposed in between adjacent diffusers 11, 12 and may spin to create pressure. The impellers may be keyed to a shaft 146. The shaft 146 may be supported by bearings inside the diffuser 11, 12. The bearing may comprise a bushing and a sleeve. The bushing may be friction fit with the diffuser 11, 12. The sleeve may be keyed to the shaft 146. The key may fit between a groove in a driveshaft 146 and a corresponding keyway in the impeller 216. The key may be present when stacking the diffusers 11, 12. As part of the assembly process, the shaft 146 may be inserted first, and then the impeller 216 may be slide along the key, and then a diffuser 11, 12 may be added, and then an impeller 216 in a repeating fashion. The key, the sleeve, and the shaft 146 may spin, and the diffusers may remain stationary. During assembly, a threaded bearing may be used to exert axially directed force on the diffusers 11, 12. The axially directed force applied to the diffusers may place them in compression, and this compression may contribute to the diffusers 11, 12 not rotating due to their engagement with the rotating impellers 216. Because of the anti-rotation feature (e.g., protrusions and recesses) of the diffusers 11, 12, less axially directed force may be required as compared with the conventional art.

Referring to FIG. 3, an exemplary diffuser stack 10 for an electric submersible pump may include a first diffuser 11 and a second diffuser 12. The "UP" and "DOWN" directional arrows indicate the typical orientation of the components inside the wellbore. The first diffuser 11 may include a first rim 14, which may be part of a female register 35 of the first diffuser 11. The first rim 14 may have a first inner circumferential surface 15, a first outer circumferential surface 16, and protrusions 17 extending radially inward from the first inner circumferential surface. The second diffuser 12 may include a second rim 18 having a second inner circumferential surface 19 and a second outer circumferential surface 20. In some embodiments, the first diffuser 11 and the second diffuser 12 are identical.

The second rim 18 may be part of a male register 34 of the second diffuser 12. Recesses 21 may be formed in the second diffuser 12. The recesses 21 may extend radially inward from the second outer circumferential surface 20. The second diffuser 12 may engage the first diffuser 11 such that the male register 34 engages the female register 35. The second outer circumferential surface 20 may engage the first inner circumferential surface 15 to centralize the first diffuser 11 and the second diffuser 12 with respect to each other. The second inner circumferential surface 19 may be concentrically disposed with respect to the first inner circumferential surface 15. The second outer circumferential surface 20 may be concentrically disposed with respect to the first outer circumferential surface 16. The protrusions 17 may engage the recesses 21. Each of the protrusions 17 may engage one of the recesses 21 to prevent axial rotation of the second diffuser 12 with respect to the first diffuser 11. The first diffuser 11 may have first vanes 30 and/or the second diffuser 12 may have second vanes 31. The first vanes 30 and the second vanes 31 may define a fluid path through the diffuser stack 10 which includes the mated first diffuser 11 and second diffuser 12. The first vanes 30 may connect the first hub 111 to the first shroud 112. The second vanes 31 may connect the second hub 121 to the second shroud 122. There may be a bore 110 in the first hub 111 for accommodating a shaft (e.g., the shaft 146 shown in FIG. 2). There may be a second bore 120 in the second hub 121 for accommodating the shaft.

The protrusions 17 may be spaced apart from each other an interval (e.g., the protrusions 17 may be evenly spaced). The recesses 21 may be spaced apart from each other by an interval (e.g., the recesses 21 may be evenly spaced). These intervals may be the same. The length of the protrusions 17 may be approximately the same as the length of the recesses 21 (e.g., sized so that the protrusions 17 fit inside the recesses 21). In some embodiments, the protrusions 17 are longer than the intervals. In some embodiments, the intervals are longer than the protrusions 17.

The first diffuser 11 may include a first lip 22 comprising an axial surface 23 and a circumferential surface 36. The second rim 18 may have a second axial end 24 having an axial surface 25. The first lip 22 may extend radially inward from the first inner circumferential surface 15. The recesses 21 may extend axially inward from the axial surface 25. The protrusions 17 may further extend axially outward from the axial surface 23. The second diffuser 12 may engage the first diffuser 11 such that the axial surface 25 abuts the axial surface 23. The second diffuser 12 may further include a second lip 26. The second lip 26 may extend radially outward from the second outer circumferential surface 20. The second lip 26 may include an axial surface 27 and a circumferential surface 36. The first diffuser 11 may include a first axial end 28 having an axial surface 29. The axial surface 29 may abut the axial surface 27.

The first diffuser 11 may include a first circumferential groove 119 formed in the first outer circumferential surface 16. The first circumferential groove 119 may contain a seal (e.g., an O-ring) for making a seal between the first diffuser 11 and the housing (e.g., housing 312 shown in FIG. 2). The second diffuser 12 may include a second circumferential groove 129 formed in a third outer circumferential surface 128 of the second diffuser 12 that is disposed radially outward with respect to the second outer circumferential surface 20. The second circumferential groove 129 may contain a seal (e.g., an O-ring) for making a seal between the second diffuser 12 and the housing.

The recesses 21 may correspond in shape with the protrusions 17. Each of the recesses 21 and each of the protrusions 17 may have a curvilinear quadrilateral cross section. That is, each of the recesses 21 and each of the protrusions 17 may have four sides and at least one of the four sides is a curved side. In the example of FIG. 3, two of the four sides are curved. In the example of FIG. 3, the curvilinear quadrilateral cross section is a curvilinear rectangular cross section. That is, two pairs of the four sides have equal or approximately equal lengths. Each of the protrusions 17 may have an axial surface 37, a circumferential surface 38, and two connecting surfaces 39 connecting the axial surface 37 and the circumferential surface 38. The connecting surfaces 39 may be radial surfaces. Each of the recesses 21 may have an axial surface 40, a circumferential surface 41, and connecting surfaces 42 connecting the axial surface 40 and the circumferential surface 41. The connecting surfaces 42 may be radial surfaces. The axial surface 37 may abut the axial surface 40. The circumferential surface 38 may abut the circumferential surface 41. The connecting surfaces 39 may abut the connecting surfaces 42.

The circumferential surface 36 may have a larger diameter than the second outer circumferential surface 20. The second outer circumferential surface 20 may have a larger diameter than the circumferential surface 41. The circumferential surface 41 may have a larger diameter than the second inner circumferential surface 19. The second inner circumferential surface 19 may have a larger diameter than a circumferential surface 43 of a lip 44 extending from the second inner circumferential surface 19. The lip 44 may have an axial surface 45. The axial surface 25 may be at the second axial end 24.

The first outer circumferential surface 16 may have a larger diameter than the first inner circumferential surface 15. The first inner circumferential surface 15 may have a larger diameter than the circumferential surface 38. The circumferential surface 38 may have a larger diameter than the circumferential surface 36. The axial surface 29 may be at the first axial end 28. A diameter of the first outer circumferential surface 16 and a diameter of the second outer circumferential surface 20 are each greater than or equal to two inches and less than or equal to five inches.

First areas 32 of the first inner circumferential surface 15 between the first lip 22 and the first axial end 28 of the first rim 14 and between the protrusions 17 may be cast surfaces (e.g., the surfaces may be cast and not machined). Second areas 33 of the first inner circumferential surface 15 between the first areas 32 and between the protrusions 17 and the first axial end 28 of the first rim 14 may be machined surfaces (e.g., the surfaces may be machined (e.g., lathed or milled)

into cast material). The protrusions 17 may be cast, e.g., the axial surface 37, the circumferential surface 38, and the connecting surfaces 39 may be cast. After the part is casted, second areas 33, the circumferential surface 38, and the circumferential surface 36 may have the same diameter. The circumferential surface 38 may then be machined to its diameter and the second areas 33 may be machined to its diameter, creating the protrusions 17. The axial surface 37 and circumferential surface 38 may be machined surfaces, and connecting surfaces 39 may be cast surfaces. A third area 46 of the second outer circumferential surface 20 between the recesses 21 and between the second lip 26 and the second axial end 24 may be a machined surface. The recesses 21 may be cast, e.g., the axial surface 40, the circumferential surface 41, and the connecting surfaces 42 may be cast surfaces.

FIG. 4 shows an alternative embodiment in which the curvilinear quadrilateral cross section of the each of the protrusions 17 and recesses 21 is a curvilinear right trapezoidal cross section. That is, one of the connecting surfaces 42 is angled and extends from the circumferential surface 41 and to second outer circumferential surface 20; and one of the connecting surfaces 39 is angled and extends from the circumferential surface 38 to the first inner circumferential surface 15. Any one or any combination of any two or more sides of the curvilinear right trapezoid may be curved. At least one angle of the curvilinear right trapezoid may be a right angle or an approximately right angle. For example, the angled connecting surface 39, 42 may be curved.

FIG. 5 shows an alternative embodiment in which the curvilinear quadrilateral cross section of the protrusions 17 and the recesses 21 comprises a curvilinear isosceles trapezoidal cross section. That is, both of the connecting surfaces 42 may be angled and/or extend from the circumferential surface 41 to the second outer circumferential surface 20; and both of the connecting surfaces 39 may be angled and/or extend from the circumferential surface 38 to the first inner circumferential surface 15. Any one or any combination of any two or more sides of the isosceles trapezoid may be curved. For example, the angled connecting surface 39, 42 may be curved.

Figure 6A:
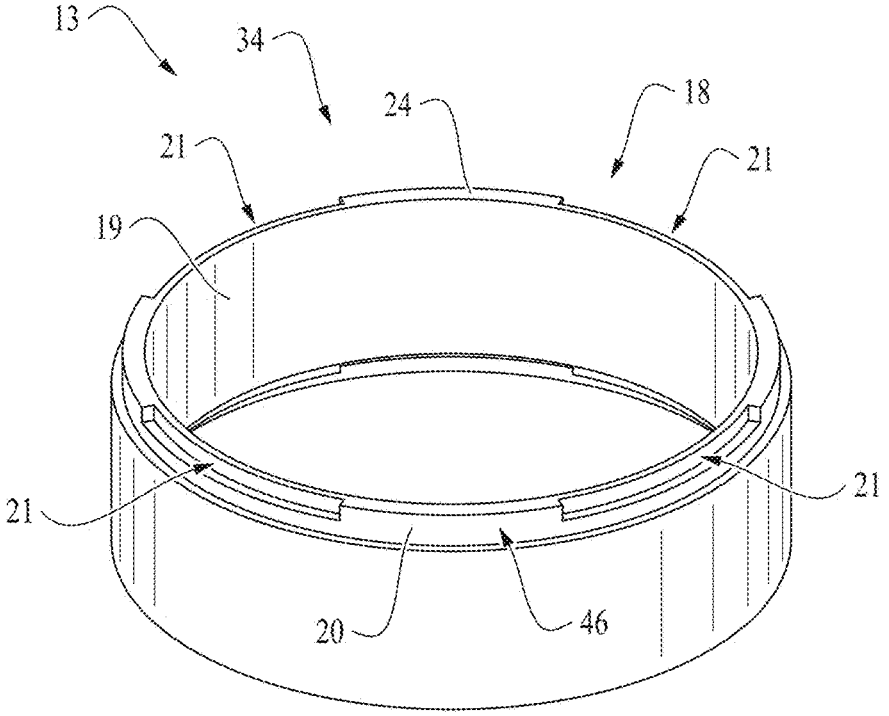
FIG. 6A is a perspective view of a spacer, according to yet another embodiment.
Figure 6B:
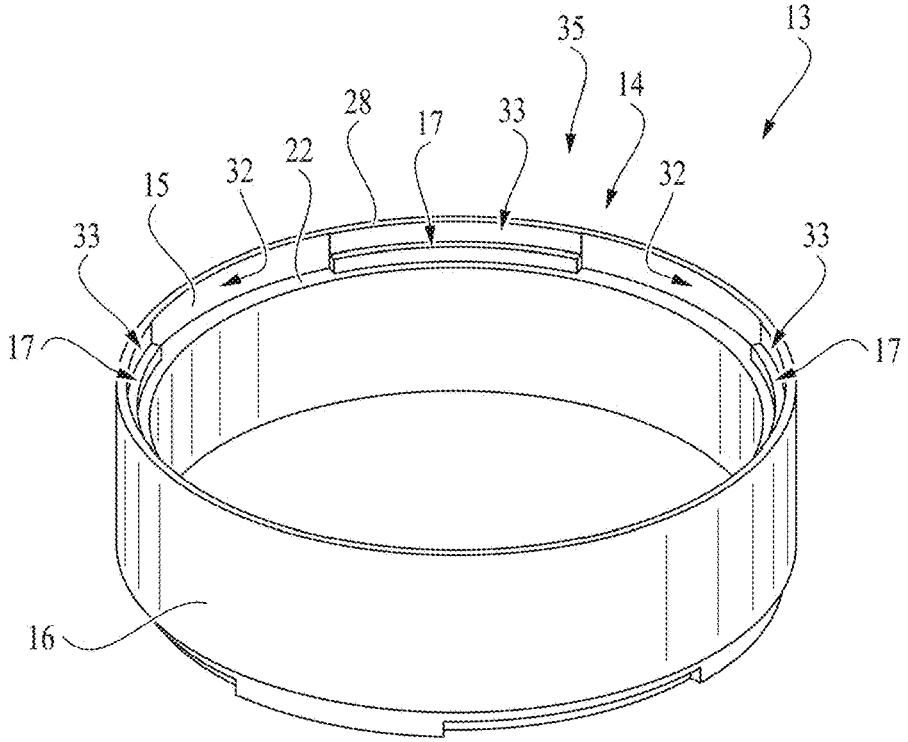
FIG. 6B is another perspective view of the spacer, according to yet another embodiment.
Figure 6C:
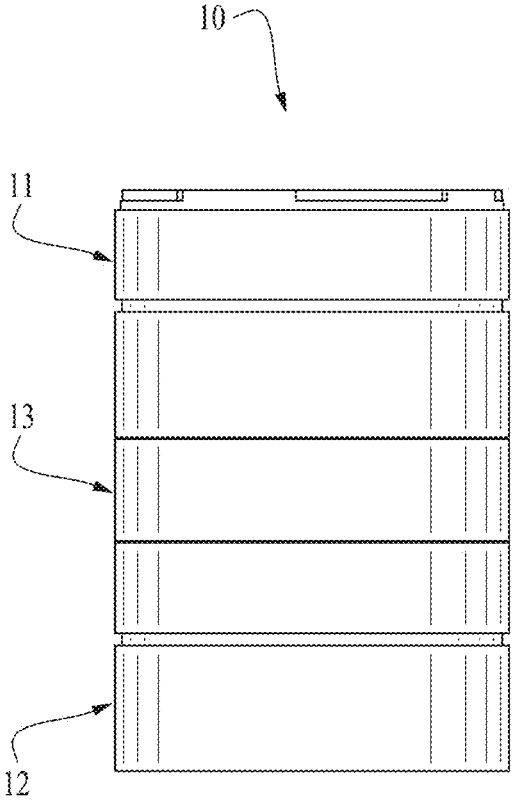
FIG. 6C is a side view of a diffuser stack, according to yet another embodiment.
Figure 6D:
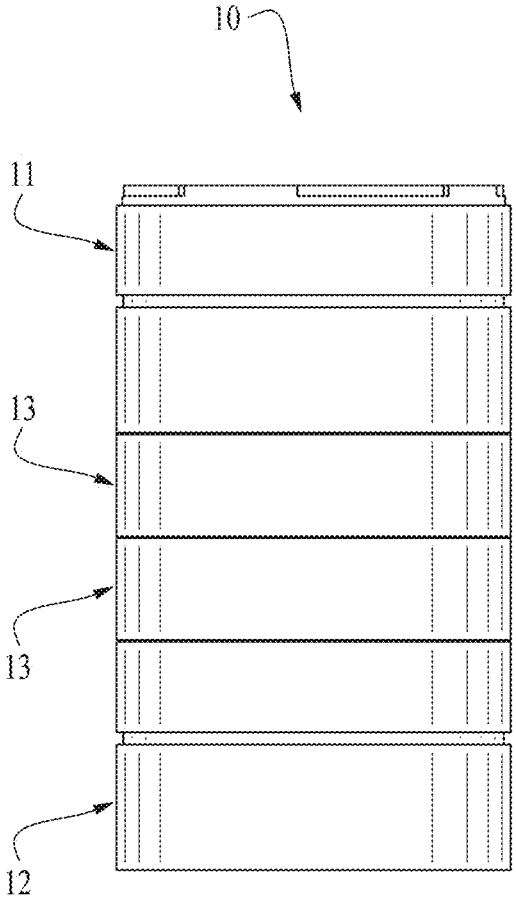
FIG. 6D is a side view of a diffuser stack, according to yet another embodiment.

FIGS. 6A-6B shows a spacer 13. The spacer 13 may have the same or similar male register and/or female register as the first diffuser 11 and/or the second diffuser 12. In some embodiments, the spacer 13 does not have vanes. In the example of FIG. 6C, the diffuser stack 10 may include a first diffuser 11, a second diffuser 12, and a spacer 13 disposed between the first diffuser 11 and the second diffuser 12. Vanes of the first diffuser 11 and the second diffuser 12 may define a fluid pathway through the diffuser stack 10. In the example of FIG. 6D, the diffuser stack 10 may include a first diffuser 11, a second diffuser 12, and two spacers 13 disposed between the first diffuser 11 and the second diffuser 12. Vanes of the first diffuser 11 and the second diffuser 12 may define a fluid pathway through the diffuser stack 10.

Figures 3A, 3B:
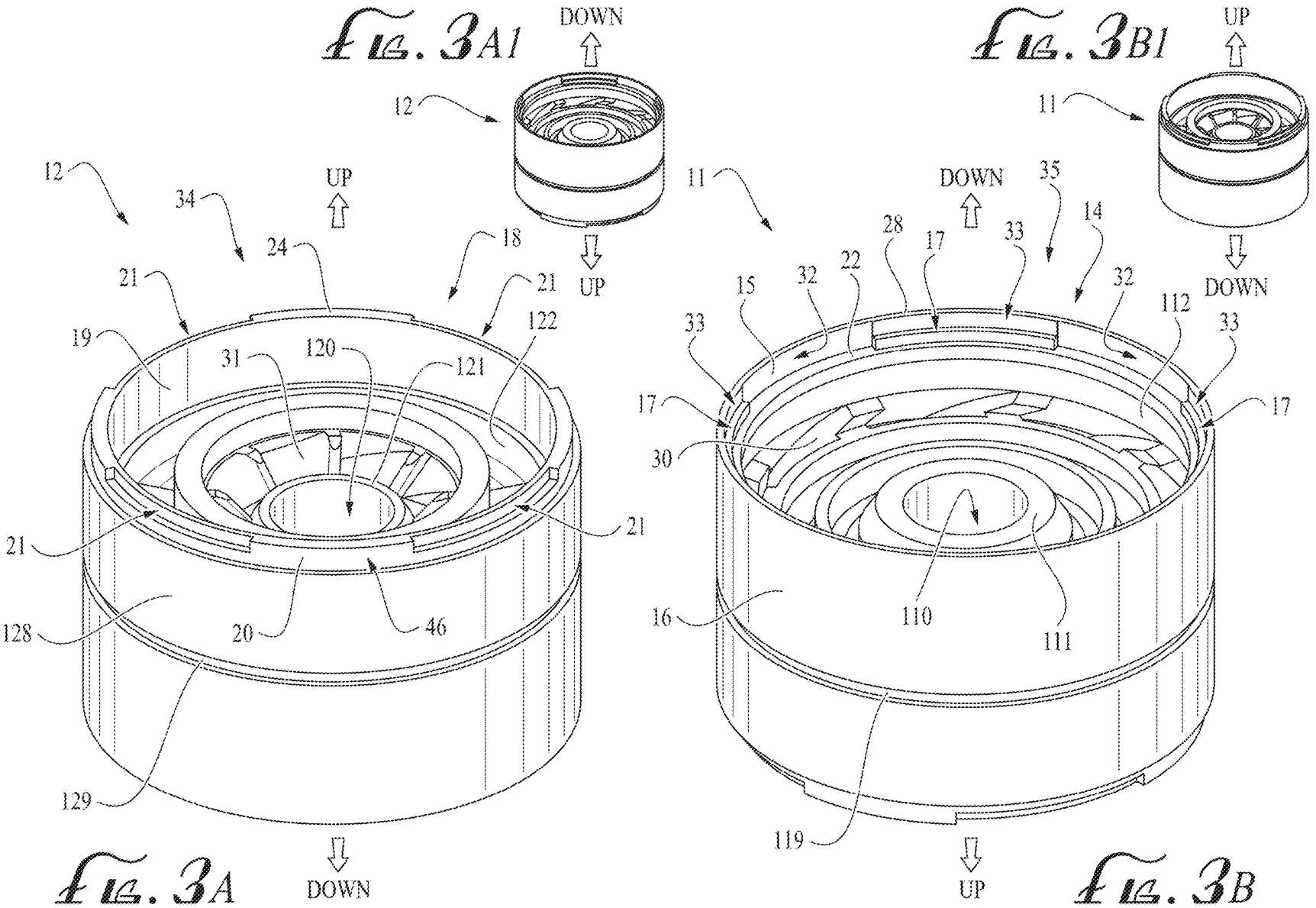
FIG. 3A is a perspective view of a diffuser having a male register, according to an embodiment.
FIG. 3B is a perspective view of a diffuser having a female register, according to the embodiment of FIG. 3A.
Figure 3C:
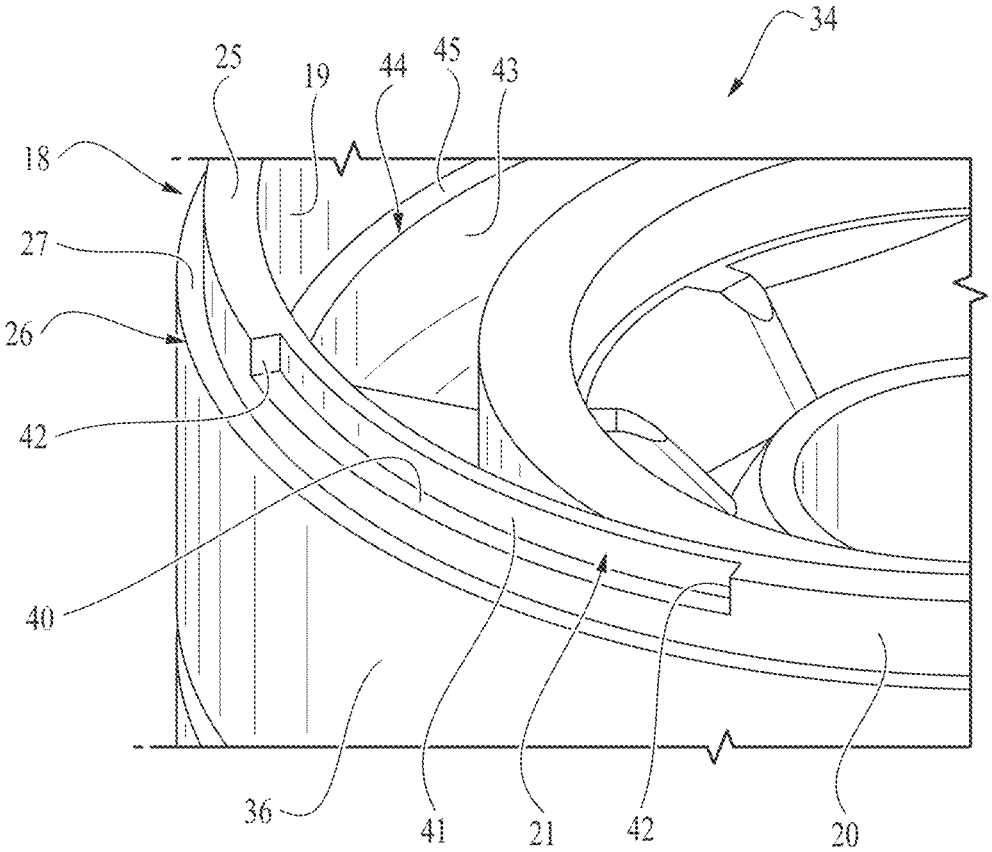
FIG. 3C is an enlarged perspective view of the male register of FIG. 3A.
Figure 3D:
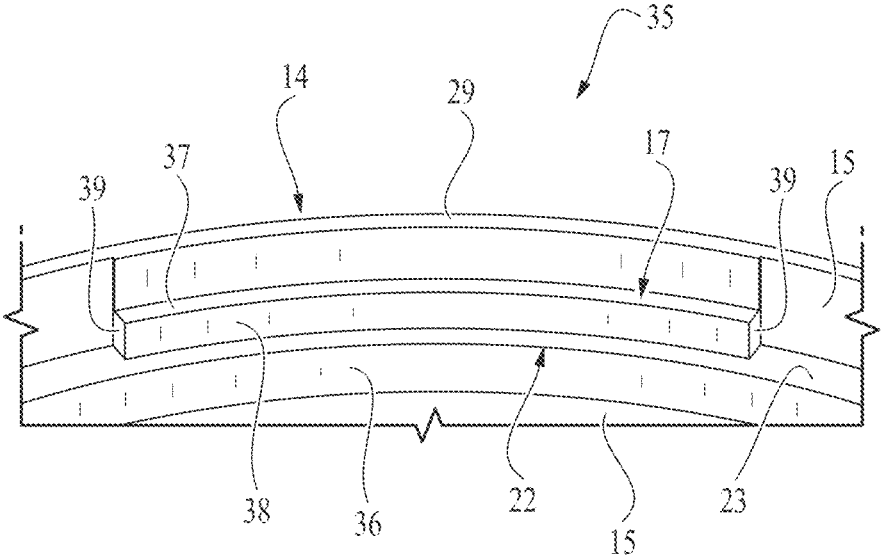
FIG. 3D is an enlarged perspective view of the female register of FIG. 3B.
Figure 3E:
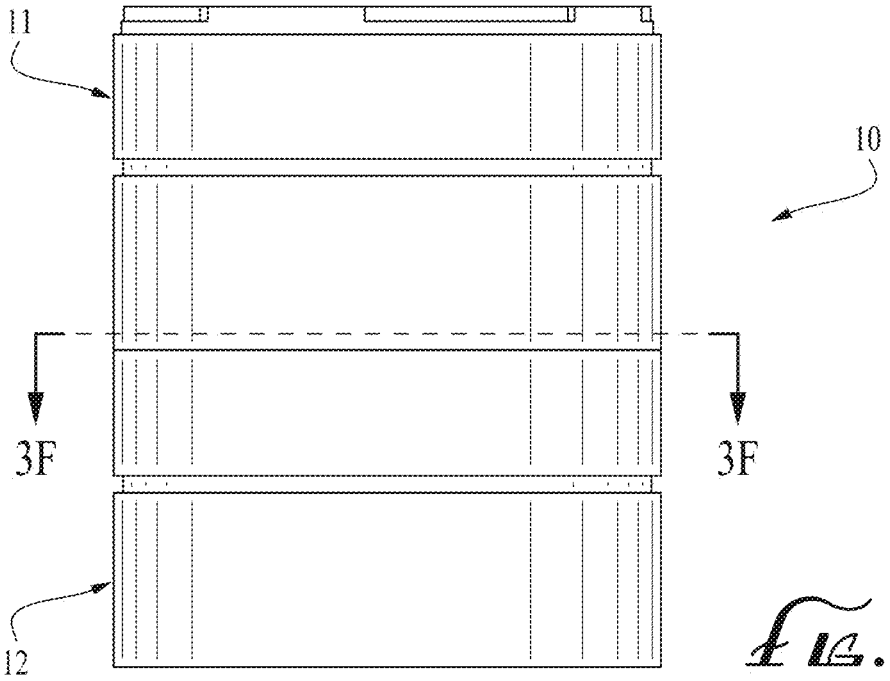
FIG. 3E is a side view of a diffuser stack formed by mating the diffusers of FIGS. 3A and 3B.
Figure 3F:
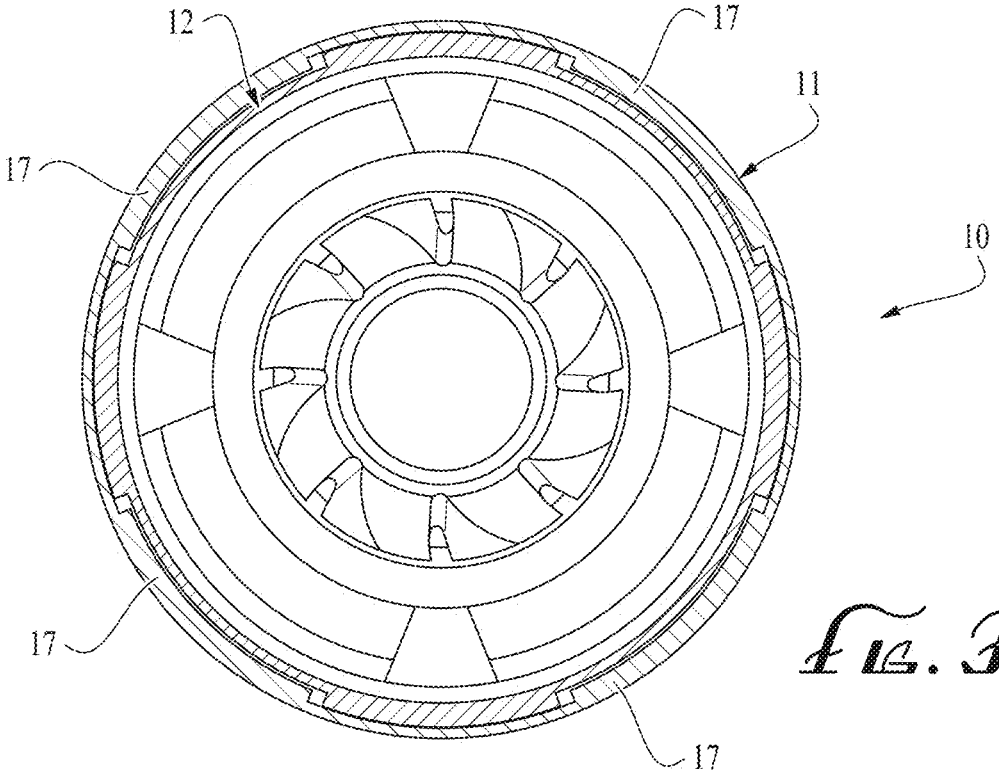
FIG. 3F is a top cross-sectional view of the diffuser stack of FIG. 3E.
Figures 4A, 4B:
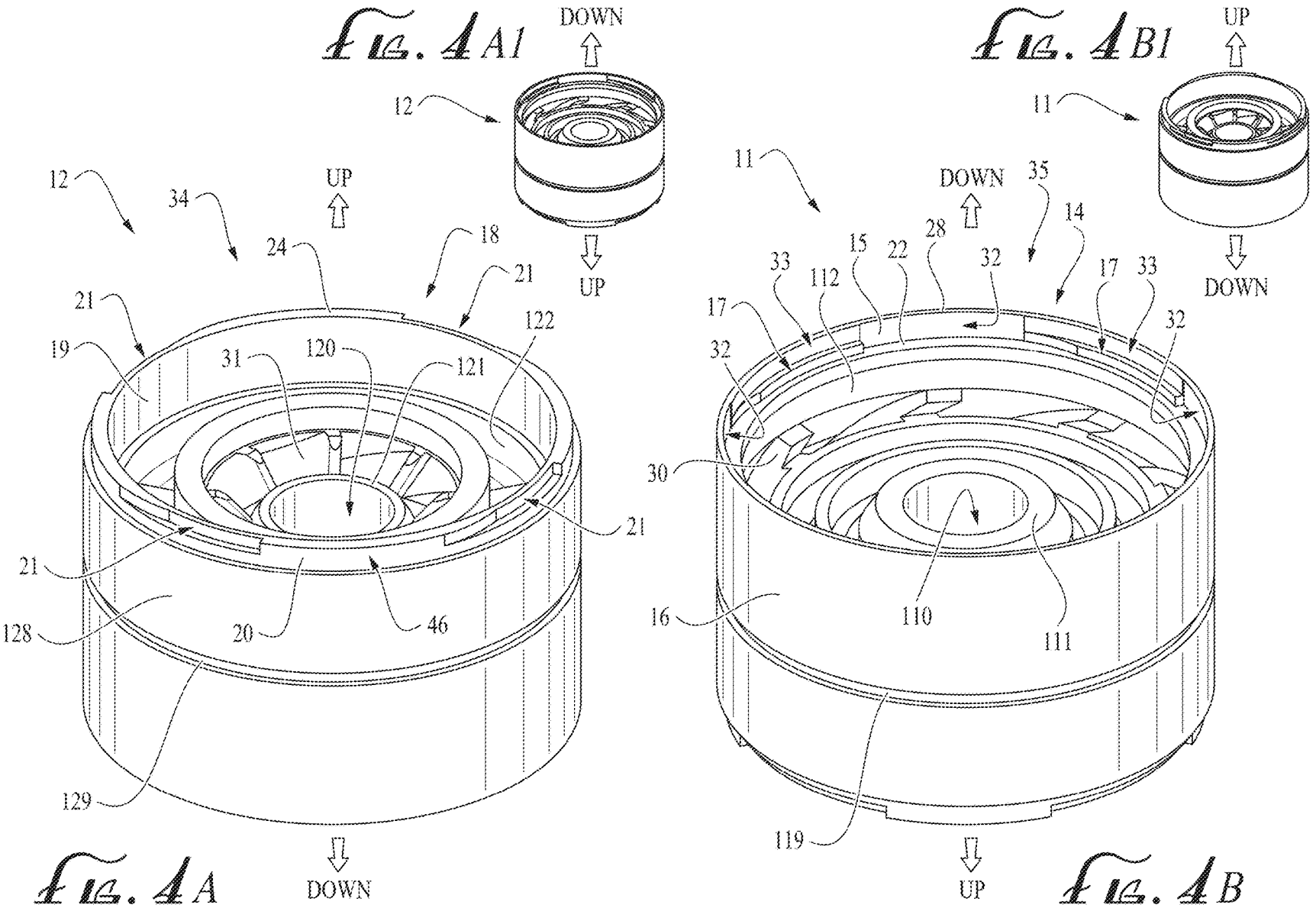
FIG. 4A is a perspective view of a diffuser having a male register, according to another embodiment.
FIG. 4B is a perspective view of a diffuser having a female register, according to the embodiment of FIG. 4A.
Figure 4C:
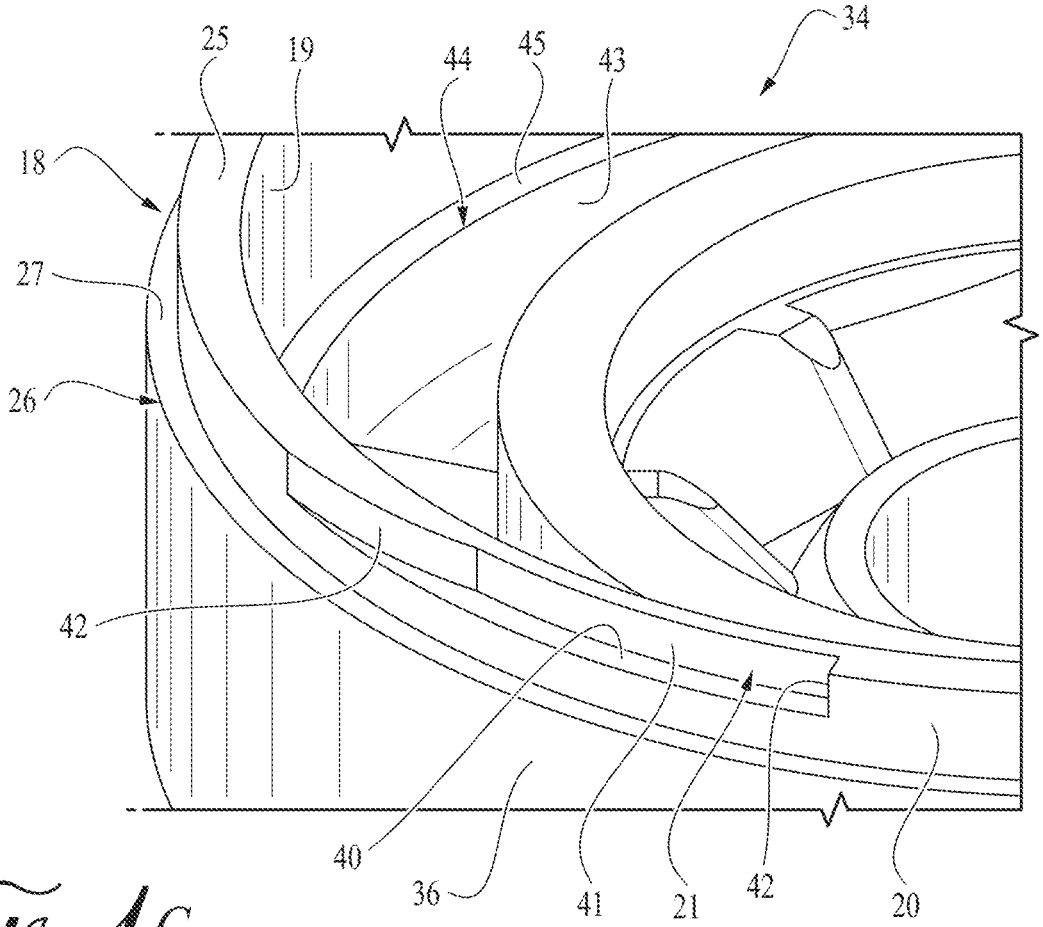
FIG. 4C is an enlarged perspective view of the male register of FIG. 4A.
Figure 4D:
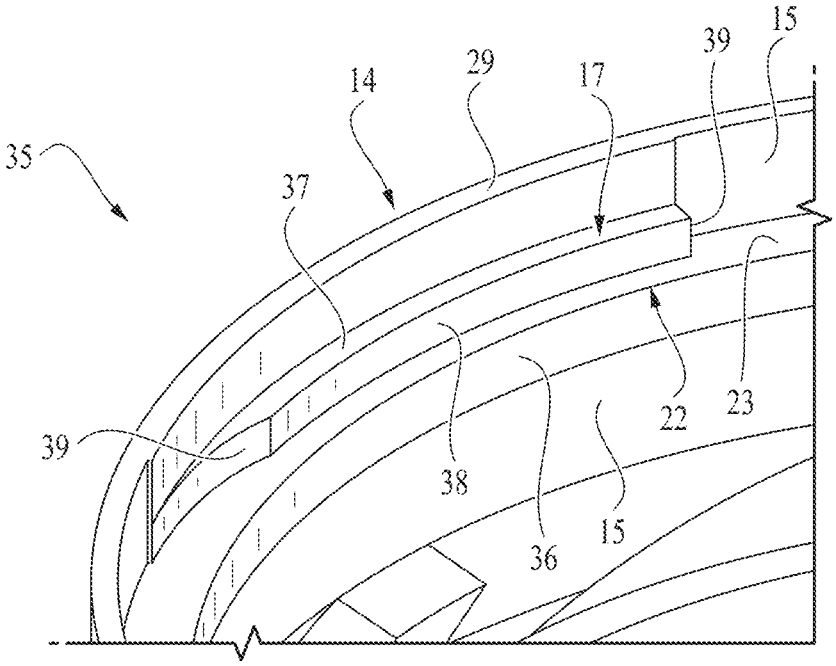
FIG. 4D is an enlarged perspective view of the female register of FIG. 4B.
Figure 4E:
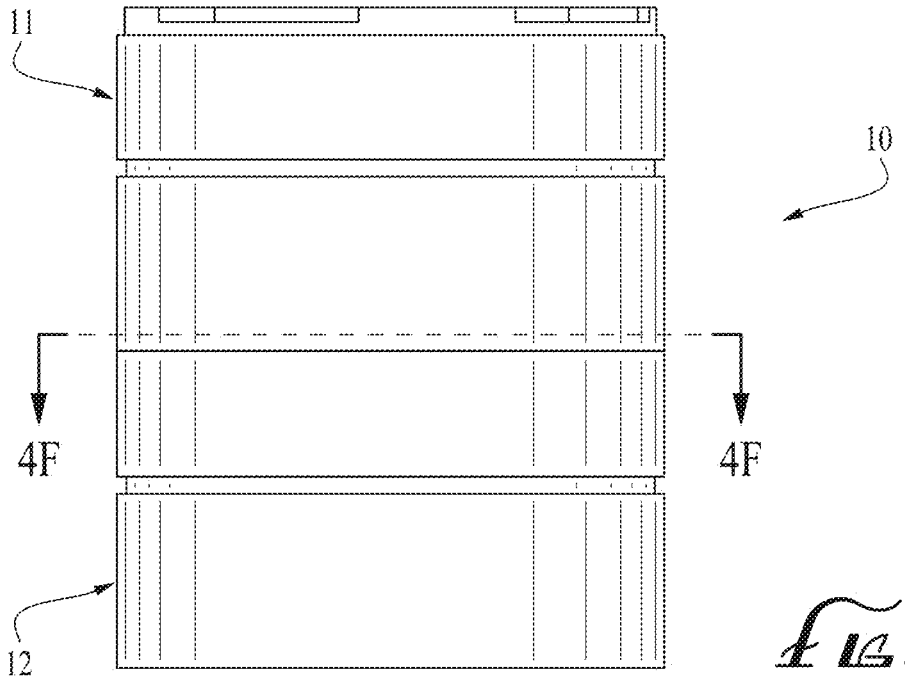
FIG. 4E is a side view of a diffuser stack formed by mating the diffusers of FIGS. 4A and 4B.
Figure 4F:
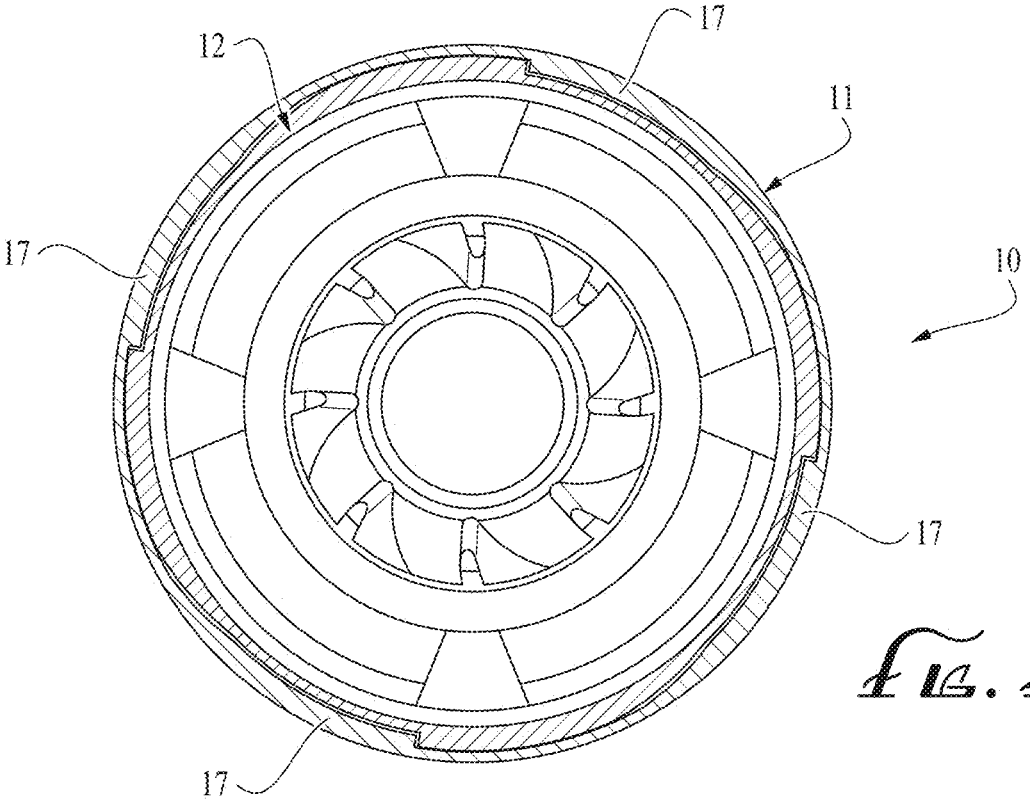
FIG. 4F is a top cross-sectional view of the diffuser stack of FIG. 4E.
Figures 5A, 5B:
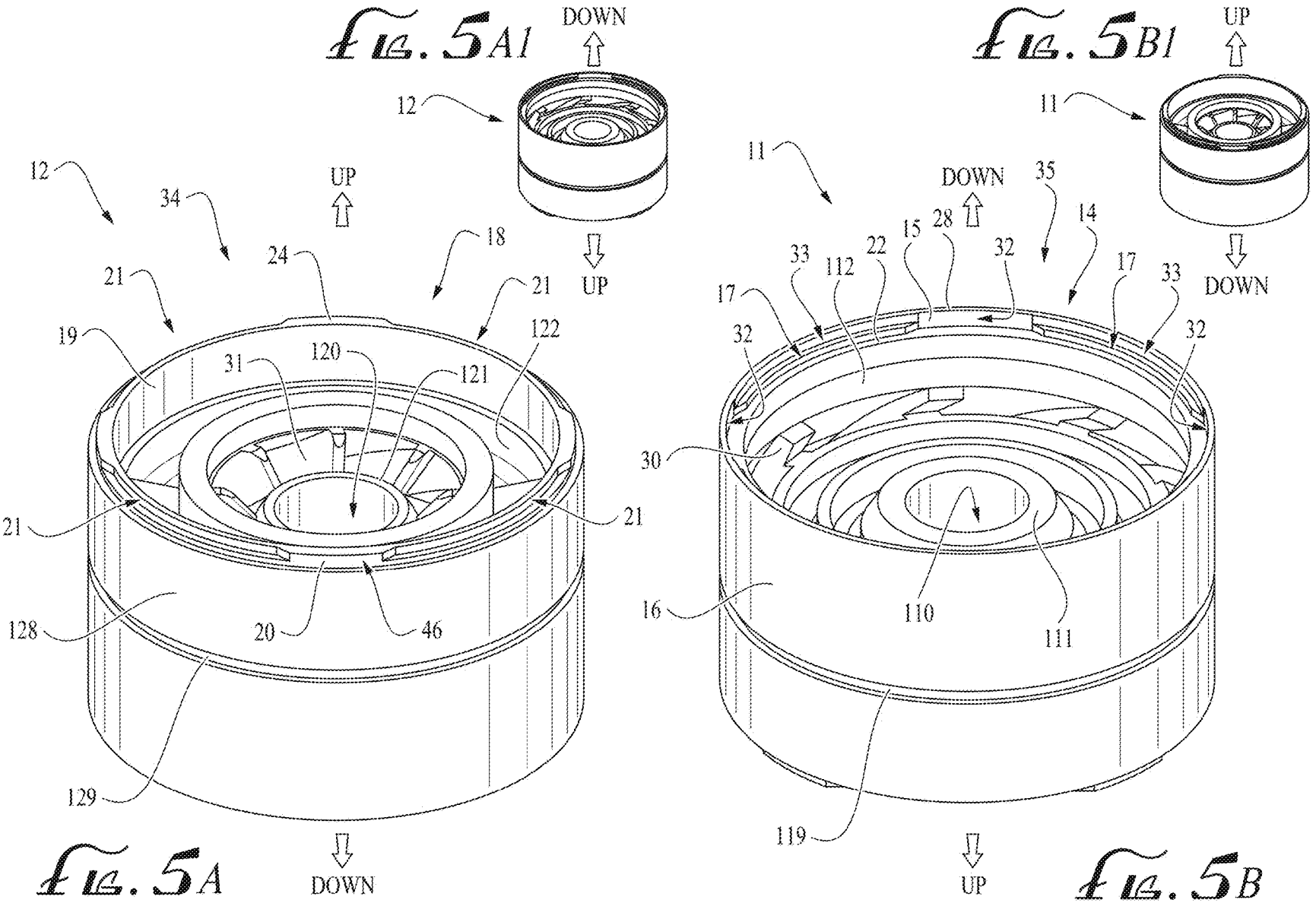
FIG. 5A is a perspective view of a diffuser having a male register, according to yet another embodiment.
FIG. 5B is a perspective view of a diffuser having a female register, according to the embodiment of FIG. 5A.
Figure 5C:
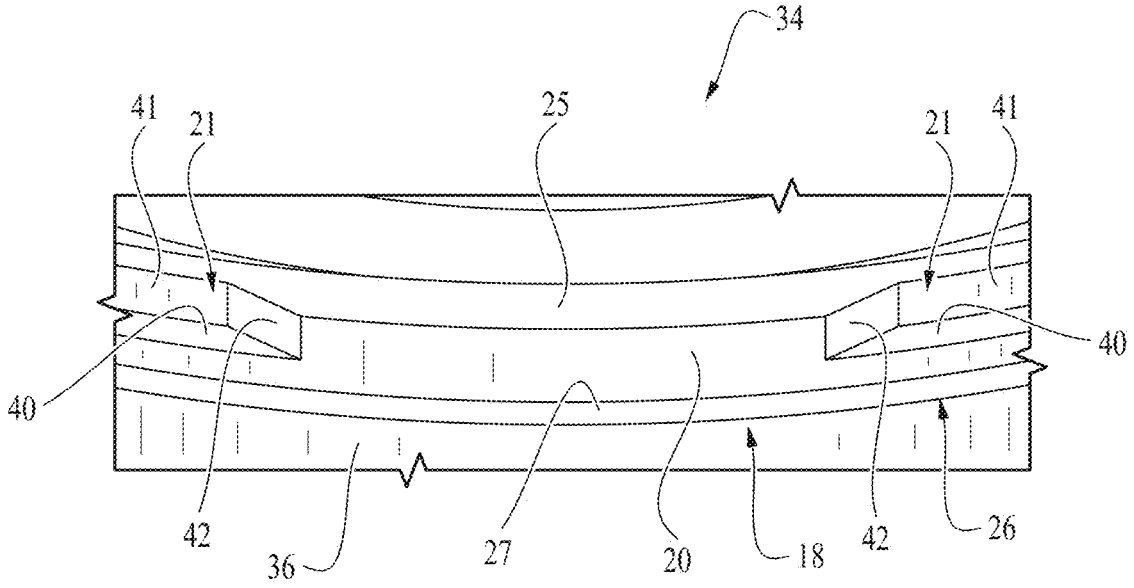
FIG. 5C is an enlarged perspective view of the male register of FIG. 5A.
Figure 5D:
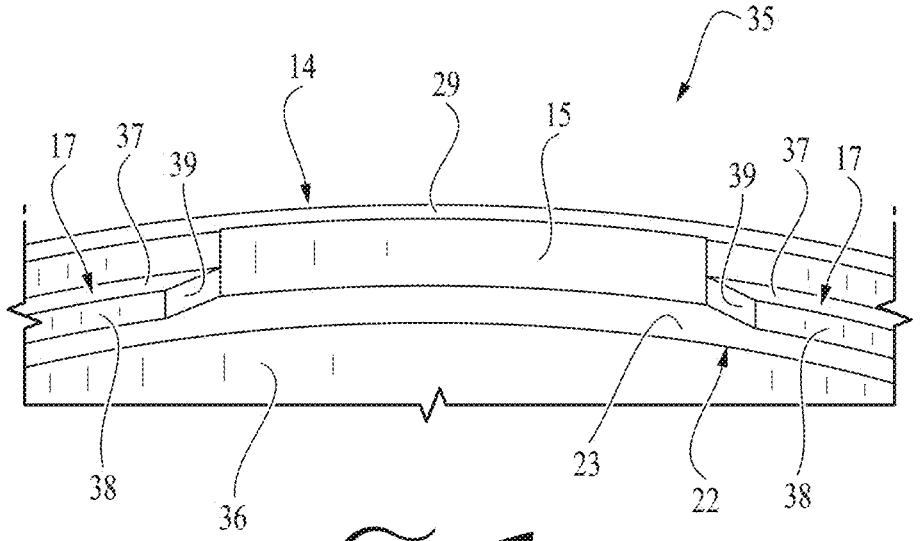
FIG. 5D is an enlarged perspective view of the female register of FIG. 5B.
Figure 5E:
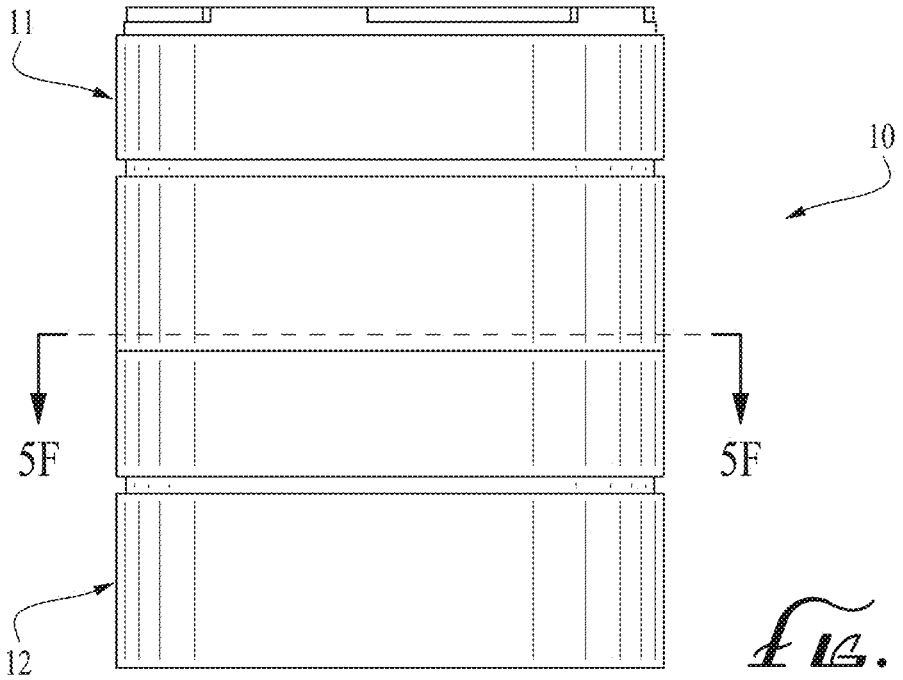
FIG. 5E is a side view of a diffuser stack formed by mating the diffusers of FIGS. 5A and 5B.
Figure 5F:
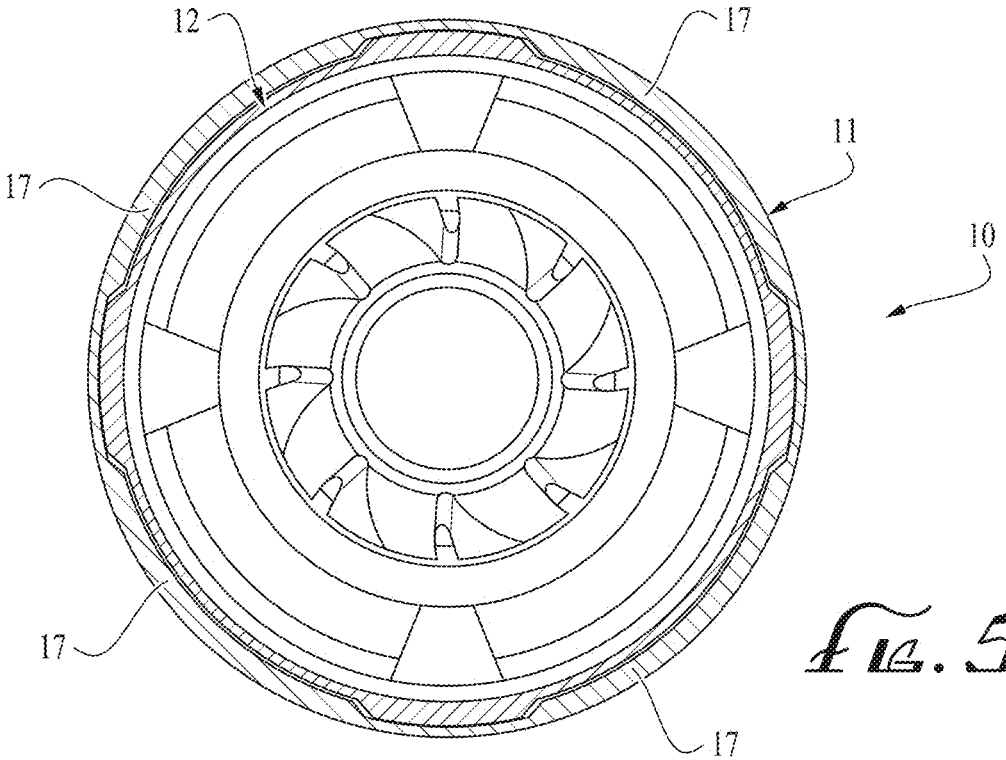
FIG. 5F is a top cross-sectional view of the diffuser stack of FIG. 5E.
Figure 7:
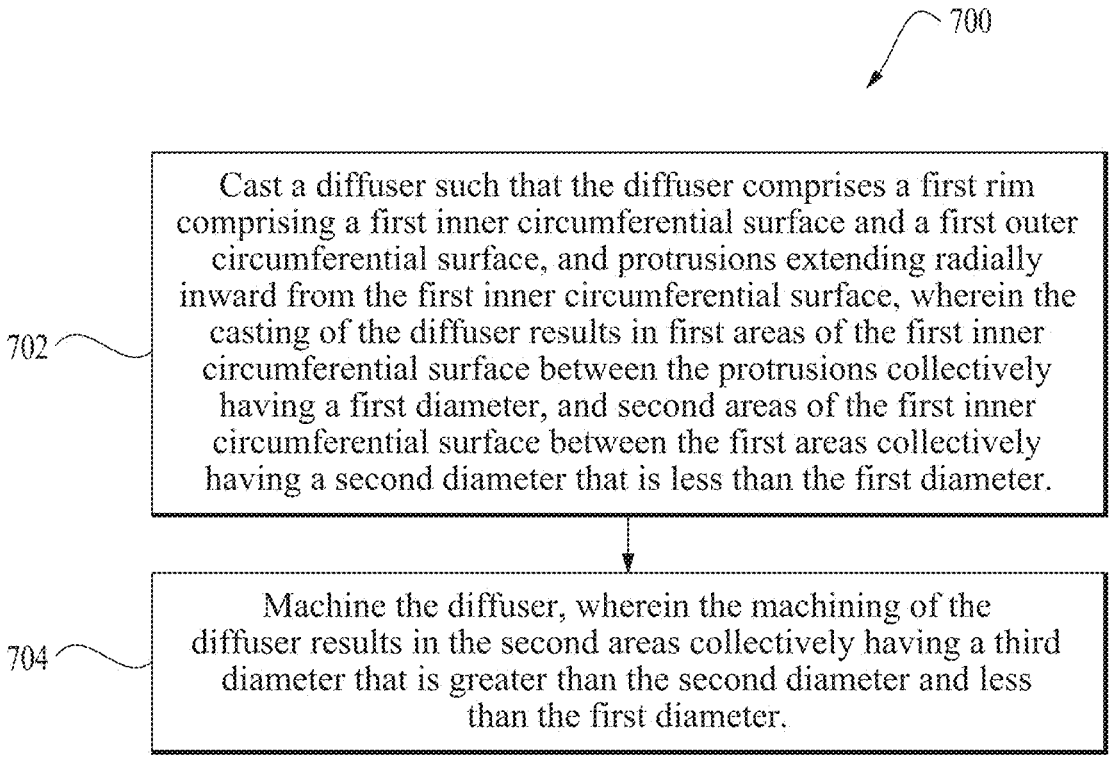
FIG. 7 is a flow diagram of a method of manufacturing a diffuser for a centrifugal pump, according to an embodiment.

Referring to FIG. 7, an exemplary method 700 of manufacturing a diffuser for a centrifugal pump (e.g., an electric submersible pump or an HPS) may include the step 702 of casting a diffuser such that the diffuser comprises a first rim comprising a first inner circumferential surface and a first outer circumferential surface, and protrusions extending radially inward from the first inner circumferential surface, wherein the casting of the diffuser results in first areas (e.g., first areas 32 as shown in FIG. 3B) of the first inner circumferential surface between the protrusions collectively having a first diameter, and second areas (e.g., second areas 33 as shown in FIG. 3B) of the inner circumferential surface between the first areas collectively having a second diameter that is less than the first diameter; and the step 704 of machining the diffuser, wherein the machining of the diffuser results in the second areas collectively having a third diameter that is greater than the second diameter and less than the first diameter. Because it is possible to get tighter tolerances for machined parts than cast parts, setting the first diameter larger than the second diameter may ensure that the areas of the second rim 18 that do not have the recesses 21 can fit between the protrusions 17. Setting the second diameter to be smaller than the first diameter may ensure that there will be material to be removed during machining to achieve the desired fit. Machining the second areas such that their diameter is reduced from the second diameter to the third diameter may be for the purpose of achieving the tolerances necessary for the second areas to have a tight fit with the second outer circumferential surface 20. That is, the first areas 32 may be cast to have a relatively large diameter to allow the first diffuser 11 to mate with the second diffuser 12; and the second areas 33 may be machined such that a tight fit with the second outer circumferential surface 20 is possible. The machining operation may remove about 0.020" to 0.50" of material.

The casting of the diffuser may include casting the diffuser such that the first diffuser further comprises a first lip extending radially inward from the first inner circumferential surface, such that the protrusions further extend axially outward from the first lip, such that the first areas are disposed between the lip and an axial end of the first rim, and such that the second areas are disposed between the protrusions and the axial end. The first areas may collectively have the first diameter that is uniform along an entire axial length of the first areas. After the casting and before the machining, the second areas may collectively have the second diameter that is uniform along an entire axial length of the second areas. After the machining, the second areas may collectively have the third diameter that is uniform along an entire axial length of the third areas.

Figure 8:
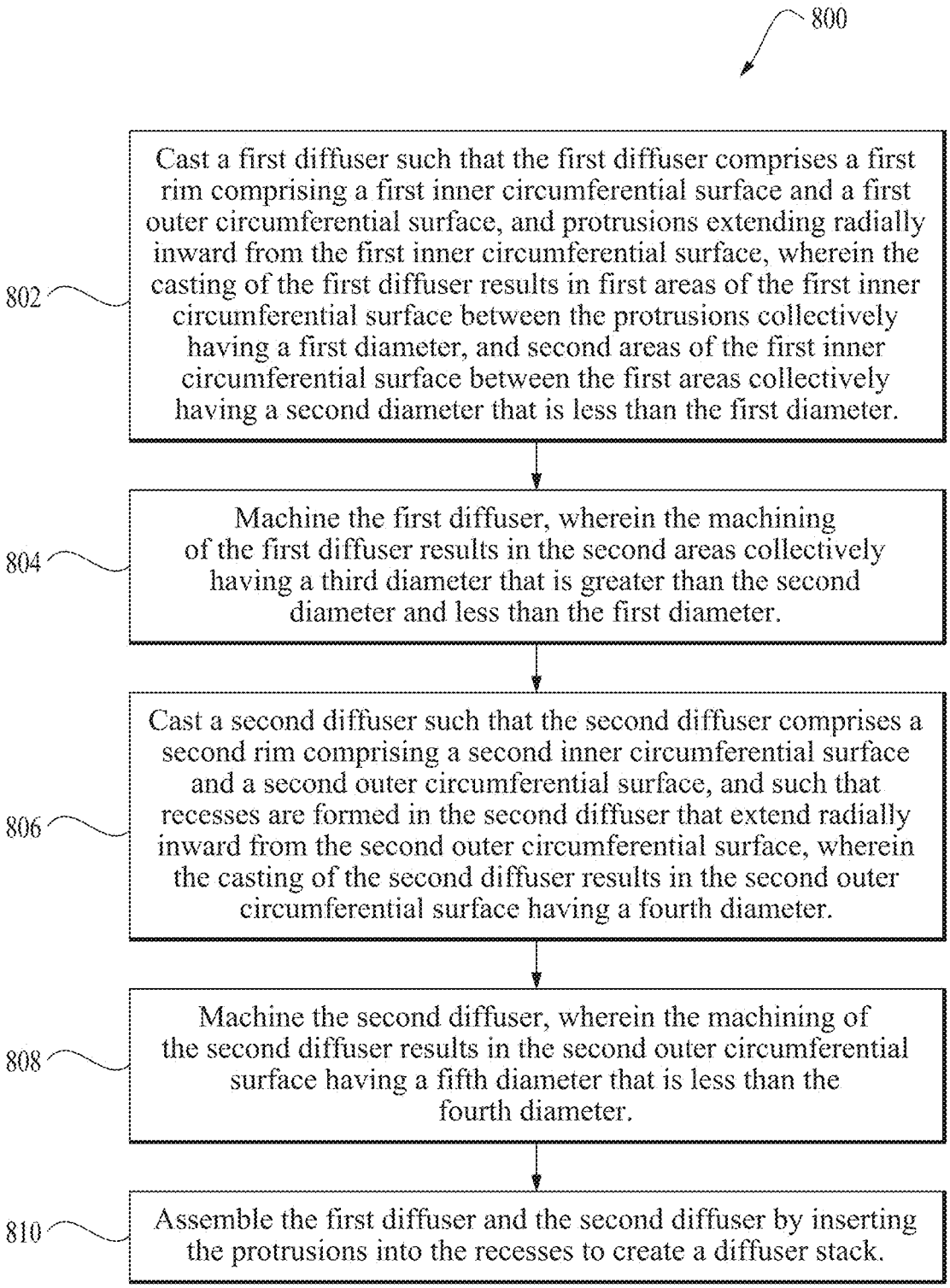
FIG. 8 is a flow diagram of a method of manufacturing a diffuser stack for a centrifugal pump, according to an embodiment.

Referring to FIG. 8, a method 800 of manufacturing a diffuser stack for a centrifugal pump (e.g., an electric submersible pump or an HPS) may include the step 802 of casting a first diffuser such that the first diffuser comprises a first rim comprising a first inner circumferential surface and a first outer circumferential surface, and protrusions extending radially inward from the first inner circumferential surface, wherein the casting of the first diffuser results in first areas (e.g., first areas 32 of FIG. 3B) of the first inner circumferential surface between the protrusions collectively having a first diameter, and second areas (e.g., second areas 33 of FIG. 3B) of the inner circumferential surface between the first areas collectively having a second diameter that is less than the first diameter; the step 804 of machining the first diffuser, wherein the machining of the first diffuser results in the second areas collectively having a third diameter that is greater than the second diameter and less than the first diameter; the step 806 of casting a second diffuser such that the second diffuser comprises a second rim comprising a second inner circumferential surface and a second outer circumferential surface, and such that recesses are formed in the second diffuser that extend radially inward from the second outer circumferential surface, wherein the casting of the second diffuser results in the second outer circumferential surface (e.g., the second outer circumferential surface 20) having a fourth diameter; the step 808 of machining the second diffuser, wherein the machining of the second diffuser results in the second outer circumferential surface having a fifth diameter that is less than the fourth diameter;

and the step 810 of assembling the first diffuser and the second diffuser by inserting the protrusions into the recesses and engaging the second outer circumferential surface with the first inner circumferential surface. The fifth diameter may be less than the third diameter. The machining of the second outer circumferential surface may be for the purpose of achieving a tight fit with the second areas for centralizing the first diffuser and the second diffuser with respect to each other.

The second diffuser may include a second lip extending from the second outer circumferential surface that has a sixth diameter that is greater than the fourth diameter. The fifth diameter may be uniform in a third area of the second outer circumferential surface between the lip and an axial end of the second rim. The assembling of the first diffuser and the second diffuser may include positioning the first inner circumferential surface around the second outer circumferential surface. The assembling of the first diffuser and the second diffuser may include abutting the axial end of the second rim against the first lip. The assembling of the first diffuser and the second diffuser may include abutting the axial end of the first rim against the second lip. A diameter of the second outer circumferential surface and a diameter of the first outer circumferential surface may be each greater than two inches and less than five inches. Alternatively, they may be less than 7, 6, 5, 4, 3, or 2 inches.

Figure 9:
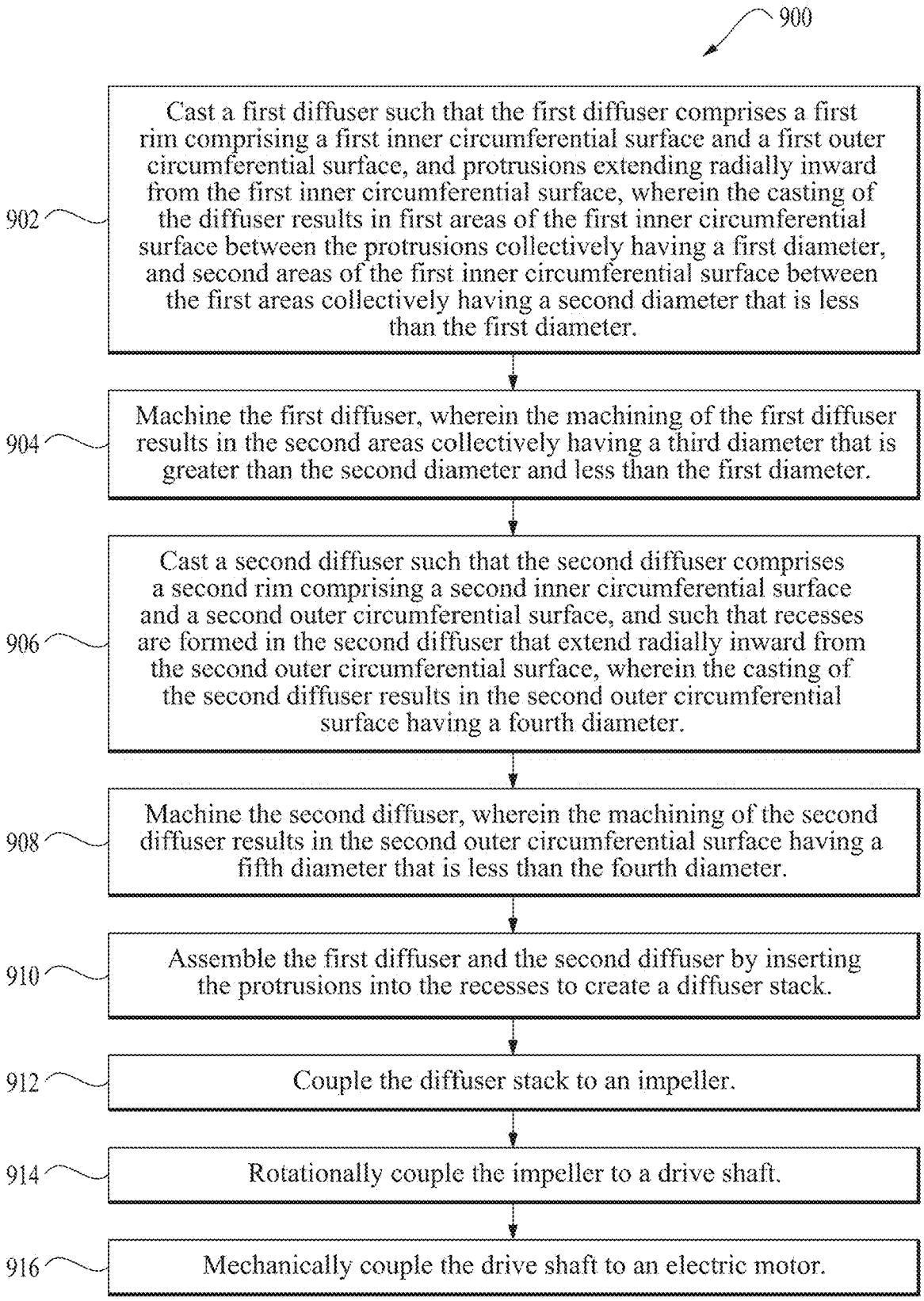
FIG. 9 is a flow diagram of a method of manufacturing a centrifugal pump, according to an embodiment.

Referring to FIG. 9, a method 900 of assembling an electric submersible pump may include the step 902 of casting a first diffuser such that the first diffuser comprises a first rim comprising a first inner circumferential surface and a first outer circumferential surface, and protrusions extending radially inward from the first inner circumferential surface, wherein the casting of the first diffuser results in first areas of the first inner circumferential surface between the protrusions collectively having a first diameter, and second areas of the first inner circumferential surface between the first areas collectively having a second diameter that is less than the first diameter; the step 904 of machining the first diffuser, wherein the machining of the first diffuser results in the second areas collectively having a third diameter that is greater than the second diameter and less than the first diameter; the step 906 of casting a second diffuser such that the second diffuser comprises a second rim comprising a second inner circumferential surface and a second outer circumferential surface, and such that recesses are formed in the second diffuser that extend radially inward from the second outer circumferential surface, wherein the casting of the second diffuser results in the second outer circumferential surface having a fourth diameter; the step 908 of machining the second diffuser, wherein the machining of the second diffuser results in the second outer circumferential surface having a fifth diameter that is less than the fourth diameter; the step 910 of assembling the first diffuser and the second diffuser by inserting the protrusions into the recesses to create a diffuser stack; the step 912 of coupling the diffuser stack to an impeller; the step 914 of rotationally coupling the impeller to a drive shaft; and the step 916 of mechanically coupling the drive shaft to an electric motor. The components may be disposed in one or more housings. Multiple pump stages may be included in the electric submersible pump. Each pump stage may include an impeller and a diffuser. The diffusers may each be manufactured in the same way or a similar way.

Figure 10:
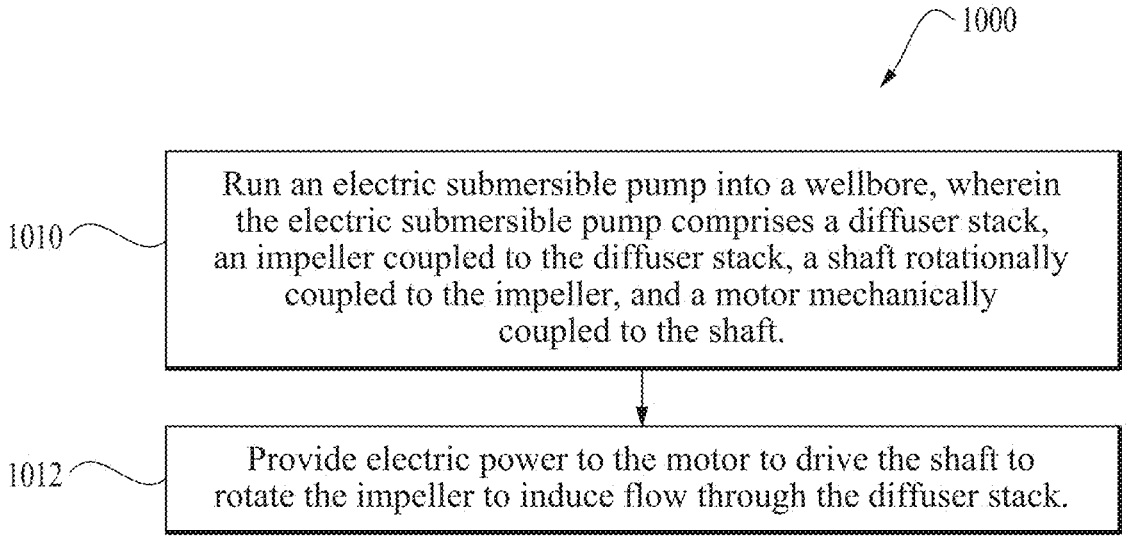
FIG. 10 is a flow diagram of a method of lifting fluid in a wellbore, according to an embodiment.

Referring to FIG. 10, a method 1000 of lifting fluid in a wellbore may include the step 1010 of running an electric submersible pump into a wellbore, wherein the electric submersible pump comprises a diffuser stack, an impeller coupled to the diffuser stack, a shaft rotationally coupled to the impeller, and a motor mechanically coupled to the shaft, wherein the diffuser stack comprises a first diffuser comprising a first rim having a first inner circumferential surface, a first outer circumferential surface, and protrusions extending radially inward from the first inner circumferential surface; and a second diffuser comprising a second rim having a second inner circumferential surface and a second outer circumferential surface, wherein recesses are formed in the second diffuser, and the recesses extend radially inward from the second outer circumferential surface, wherein the second diffuser is configured to engage the first diffuser such that the second outer circumferential surface engages the first inner circumferential surface and the protrusions engage the recesses; and the step 1012 of providing electric power to the motor to drive the shaft to rotate the impeller to induce flow (e.g., flow of oil, gas, water, and/or other fluids) through the impeller and the diffuser.

The system and method of the present disclosure may present the advantage in that anti-rotation features (e.g., protrusions) may be formed in the diffuser by casting; the anti-rotation features may be difficult or impossible to fully form by machining techniques such as milling or lathing. Tolerances achieved by casting alone would not ordinarily allow for a tight fit with another diffuser, but the machining step after the casting step may allow for relatively tight tolerances to be achieved, thus enabling a tight fit between the diffusers for effective centralization and alignment. Accordingly, the diffuser stack manufactured by the specific casting and machining steps described herein may prevent the diffusers from rotating with respect to each other and also may provide effective centralization and alignment.

ADDITIONAL DISCLOSURE

The following are non-limiting, specific embodiments in accordance with the present disclosure:

In a first embodiment, a diffuser stack for a centrifugal pump (e.g., an electric submersible pump or an HPS) comprises a first diffuser comprising a first rim having a first inner circumferential surface, a first outer circumferential surface, and protrusions extending radially inward from the first inner circumferential surface; and a second diffuser comprising a second rim having a second inner circumferential surface and a second outer circumferential surface, wherein recesses are formed in the second diffuser, and the recesses extend radially inward from the second outer circumferential surface, wherein the second diffuser is configured to engage the first diffuser such that the second outer circumferential surface engages the first inner circumferential surface and the protrusions engage the recesses.

A second embodiment can include the diffuser stack of the first embodiment, wherein the second diffuser is configured to engage the first diffuser such that each of the protrusions engages one of the recesses to prevent axial rotation of the second diffuser with respect to the first diffuser.

A third embodiment can include the diffuser stack of the first or second embodiments, wherein the protrusions are spaced apart from each other by an interval.

A fourth embodiment can include the diffuser stack of any of the first through third embodiments, wherein the recesses are spaced apart from each other by an interval.

A fifth embodiment can include the diffuser stack of any of the first through fourth embodiments, wherein the second diffuser is further configured to engage the first diffuser such that the second inner circumferential surface is concentrically disposed with respect to the first inner circumferential surface.

A sixth embodiment can include the diffuser stack of any of the first through fifth embodiments, wherein the second diffuser is further configured to engage the first diffuser such that the second outer circumferential surface is concentrically disposed with respect to the first outer circumferential surface.

A seventh embodiment can include the diffuser stack of any of the first through sixth embodiments, wherein the first diffuser comprises a lip comprising a first axial surface, and the second rim comprises an axial end having a second axial surface.

An eighth embodiment can include the diffuser stack of any of the first through seventh embodiments, wherein the lip extends radially inward from the first inner circumferential surface.

A ninth embodiment can include the diffuser stack of any of the first through eighth embodiments, wherein the recesses further extend axially inward from the second axial surface.

A tenth embodiment can include the diffuser stack of any of the first through ninth embodiments, wherein the protrusions further extend axially outward from the first axial surface.

An eleventh embodiment can include the diffuser stack of any of the first through tenth embodiments, wherein the second diffuser is further configured to engage the first diffuser such that the second axial surface abuts the first axial surface.

A twelfth embodiment can include the diffuser stack of any of the first through eleventh embodiments, wherein the second diffuser further comprises a lip comprising a third axial surface, and the first diffuser comprises an axial end having a fourth axial surface.

A thirteenth embodiment can include the diffuser stack of any of the first through twelfth embodiments, wherein the second diffuser is further configured to engage the first diffuser such that the third axial surface abuts the fourth axial surface.

A fourteenth embodiment can include the diffuser stack of any of the first through thirteenth embodiments, wherein the recesses correspond in shape with the protrusions.

A fifteenth embodiment can include the diffuser stack of any of the first through fourteenth embodiments, wherein each of the recesses and each of the protrusions has a curvilinear quadrilateral cross section.

A sixteenth embodiment can include the diffuser stack of any of the first through fifteenth embodiments, wherein the curvilinear quadrilateral cross section comprises a curvilinear rectangular cross section.

A seventeenth embodiment can include the diffuser stack of any of the first through sixteenth embodiments, wherein the curvilinear quadrilateral cross section comprises a curvilinear right trapezoidal cross section.

An eighteenth embodiment can include the diffuser stack of any of the first through seventeenth embodiments, wherein the curvilinear quadrilateral cross section comprises a curvilinear isosceles trapezoidal cross section.

A nineteenth embodiment can include the diffuser stack of any of the first through eighteenth embodiments, wherein the first diffuser is configured to engage with an impeller.

A twentieth embodiment can include the diffuser stack of any of the first through nineteenth embodiments, wherein the second diffuser is configured to engage with an impeller.

A twenty-first embodiment can include the diffuser stack of any of the first through twentieth embodiments, wherein the first diffuser comprises vanes.

A twenty-second embodiment can include the diffuser stack of any of the first through twenty-first embodiments, wherein the second diffuser comprises vanes.

A twenty-third embodiment can include the diffuser stack of any of the first through twenty-second embodiments, wherein the first diffuser comprises first vanes and the second diffuser comprises second vanes.

A twenty-fourth embodiment can include the diffuser stack of any of the first through twenty-third embodiments, wherein further comprising a spacer disposed between the second diffuser and a third diffuser.

A twenty-fifth embodiment can include the diffuser stack of any of the first through twenty-fourth embodiments, further comprising a first spacer and a second spacer disposed between the first diffuser and the second diffuser.

A twenty-sixth embodiment can include the diffuser stack of any of the first through twenty-fifth embodiments, wherein the spacer does not have vanes.

A twenty-seventh embodiment can include the diffuser stack of any of the first through twenty-sixth embodiments, wherein the first diffuser comprises a lip extending from the first inner circumferential surface, wherein first areas of the first inner circumferential surface between the lip and an axial end of the first rim and between the protrusions are cast surfaces, and second areas of the first inner circumferential surface between the first areas and between the protrusions and the axial end of the first rim are machined surfaces.

A twenty-eighth embodiment can include the diffuser stack of any of the first through twenty-seventh embodiments, wherein a diameter of the second outer circumferential surface and a diameter of the first outer circumferential surface are each greater than or equal to two inches and less than or equal to five inches.

In a twenty-ninth embodiment, a method of manufacturing a diffuser for a pump (e.g., an ESP or an HPS) comprises casting a diffuser such that the diffuser comprises a first rim comprising a first inner circumferential surface and a first outer circumferential surface, and protrusions extending radially inward from the first inner circumferential surface, wherein the casting of the diffuser results in first areas of the first inner circumferential surface between the protrusions collectively having a first diameter, and second areas of the first inner circumferential surface between the first areas collectively having a second diameter that is less than the first diameter; and machining the diffuser, wherein the machining of the diffuser results in the second areas collectively having a third diameter that is greater than the second diameter and less than the first diameter.

A thirtieth embodiment can include the method of the twenty-ninth embodiment, wherein the casting of the diffuser comprises casting the diffuser such that the diffuser further comprises a first lip extending radially inward from the first inner circumferential surface, such that the protrusions further extend axially outward from the first lip, such that the first areas are disposed between the lip and an axial end of the first rim, and such that the second areas are disposed between the protrusions and the axial end.

A thirty-first embodiment can include the method of the twenty-ninth or thirtieth embodiments, wherein the first areas collectively have the first diameter that is uniform along an entire axial length of the first areas.

A thirty-second embodiment can include the method of any of the twenty-ninth through thirty-first embodiments, wherein after the casting and before the machining, the second areas collectively have the second diameter that is uniform along an entire axial length of the second areas.

A thirty-third embodiment can include the method of any of the twenty-ninth through thirty-second embodiments, wherein after the machining, the second areas collectively have the third diameter that is uniform along an entire axial length of the third areas.

In a thirty-fourth embodiment, a method of manufacturing a diffuser stack for a pump (e.g., an ESP or an HPS) comprises manufacturing a first diffuser according to the method of any of the twenty-ninth through thirty-third embodiments; casting a second diffuser such that the second diffuser comprises a second rim comprising a second inner circumferential surface and a second outer circumferential surface, and such that recesses are formed in the second diffuser that extend radially inward from the second outer circumferential surface, wherein the casting of the second diffuser results in the second outer circumferential surface having a fourth diameter; machining the second diffuser, wherein the machining of the second diffuser results in the second outer circumferential surface having a fifth diameter that is less than the fourth diameter; and assembling the first diffuser and the second diffuser by inserting the protrusions into the recesses to create a diffuser stack.

A thirty-fifth embodiment can include the method of the thirty-fourth embodiment, wherein the second diffuser comprises a second lip extending from the second outer circumferential surface that has a sixth diameter that is greater than the fourth diameter.

A thirty-sixth embodiment can include the method of the thirty-fourth or thirty-fifth embodiments, wherein the fifth diameter is uniform in a third area of the second outer circumferential surface between the lip and an axial end of the second rim.

A thirty-seventh embodiment can include the method of any of the thirty-fourth through thirty-sixth embodiments, wherein the assembling of the first diffuser and the second diffuser comprises positioning the first inner circumferential surface around the second outer circumferential surface.

A thirty-eighth embodiment can include the method of any of the thirty-fourth through thirty-seventh embodiments, wherein the assembling of the first diffuser and the second diffuser comprises abutting the axial end of the second rim against the first lip.

A thirty-ninth embodiment can include the method of any of the thirty-fourth through thirty-eighth embodiments, wherein the assembling of the first diffuser and the second diffuser comprising abutting the axial end of the first rim against the second lip.

A fortieth embodiment can include the method of any of the thirty-fourth through thirty-ninth embodiments, wherein a diameter of the second outer circumferential surface and a diameter of the first outer circumferential surface are each greater than two inches and less than five inches.

In a forty-first embodiment, a method of assembling an ESP comprises manufacturing a diffuser stack according to the method of any of the thirty-fourth through fortieth embodiments; coupling the diffuser stack to an impeller; placing the diffuser stack and the impeller inside a housing; rotationally coupling a first drive shaft of an electric motor to a second drive shaft of a seal section; rotationally coupling the second drive shaft to a third drive shaft disposed at least partially within the housing; and rotationally coupling the impeller to the third drive shaft.

In a forty-second embodiment, a method of lifting fluid in a wellbore comprises running an ESP into a wellbore, wherein ESP comprises the diffuser stack of any of the first through twenty-eighth embodiments, an impeller coupled to the diffuser stack; a shaft rotationally coupled to the impeller, and a motor mechanically coupled to the shaft; and providing electric power to the motor to drive the shaft to rotate the impeller to induce flow through the diffuser stack.

In a forty-third embodiment, a diffuser for a centrifugal pump (e.g., an ESP or an HPS) comprises a first rim having a first inner circumferential surface, a first outer circumferential surface, and protrusions extending radially inward from the first inner circumferential surface, wherein the first rim is disposed at a first axial end of the diffuser; and a second rim having a second inner circumferential surface and a second outer circumferential surface, wherein recesses are formed in the second diffuser, wherein the recesses extend radially inward from the second outer circumferential surface, wherein the second rim is disposed at a second axial end of the diffuser, wherein the first rim is configured to engage with a rim of a second diffuser of the pump and wherein the second rim is configured to engage with a rim of a third diffuser of the pump.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" does not require selection of only one element. Thus, the phrase "A or B" is satisfied by either one or both elements from the set {A, B}, including multiples of either element; and the phrase "A, B, or C" is satisfied by any element from the set {A, B, C} or any combination thereof, including multiples of any element. A clause that recites "A, B, or C" can be infringed with only one of the listed items, multiple of the listed items, and one or more of the items in the list and another item not listed.

As used herein, the article "a" means "one or more." As used herein, the article "an" means "one or more." As used herein, the article "the" when referring to a singular noun means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A diffuser stack for a centrifugal pump, comprising:

a first diffuser comprising a first rim having a first inner circumferential surface, a first outer circumferential surface, and protrusions extending radially inward from the first inner circumferential surface, wherein first areas of the first inner circumferential surface between the protrusions collectively have a first diameter, second areas of the first inner circumferential surface between the first areas and axially outward of the protrusions have a third diameter that is less than the first diameter, and each protrusion extends radially inward beyond the third diameter; and a second diffuser comprising a second rim having a second inner circumferential surface and a second outer circumferential surface, wherein recesses are formed in the second diffuser, wherein the recesses extend radially inward from the second outer circumferential surface, and wherein the second diffuser is configured to engage the first diffuser such that the second outer circumferential surface engages the first inner circumferential surface and the protrusions engage the recesses.

2. The diffuser stack of claim 1, wherein the second diffuser is further configured to engage the first diffuser such that each of the protrusions engages one of the recesses to prevent axial rotation of the second diffuser with respect to the first diffuser.

3. The diffuser stack of claim 1, wherein each of the recesses and each of the protrusions has a curvilinear quadrilateral cross section.

4. The diffuser stack of claim 3, wherein the curvilinear quadrilateral cross section comprises a curvilinear rectangular cross section.

5. The diffuser stack of claim 3, wherein the curvilinear quadrilateral cross section comprises a curvilinear right trapezoidal cross section.

6. The diffuser stack of claim 3, wherein the curvilinear quadrilateral cross section comprises a curvilinear isosceles trapezoidal cross section.

7. The diffuser stack of claim 1, wherein the first diffuser is configured to engage with an impeller.

8. The diffuser stack of claim 7, wherein the second diffuser is configured to engage with the impeller.

9. The diffuser stack of claim 1, wherein the first diffuser comprises vanes and/or wherein the second diffuser comprises vanes.

10. The diffuser stack of claim 1, wherein the first diffuser is identical to the second diffuser.

11. The diffuser stack of claim 1, further comprising a spacer disposed between the first diffuser and the second diffuser.

12. The diffuser stack of claim 1, wherein the first diffuser comprises a lip extending from the first inner circumferential surface, wherein first areas of the first inner circumferential surface between the lip and an axial end of the first rim and between the protrusions are cast surfaces, and second areas of the first inner circumferential surface between the first areas and between the protrusions and the axial end of the first rim are machined surfaces.

13. The diffuser stack of claim 1, wherein a diameter of the first outer circumferential surface and a diameter of the second outer circumferential surface are each greater than or equal to two inches and less than or equal to fifteen inches.

14. The diffuser stack of claim 1, wherein the first diffuser further comprises a third rim, and the second diffuser further comprises a fourth rim.

15. The diffuser stack of claim 1, wherein an entirety of each of the protrusions is machined, and an entirety of each of the recesses is machined.

16. The diffuser stack of claim 1, wherein the first rim is disposed at a first axial end of the first diffuser, the first diffuser further comprises a third rim disposed at a second axial end of the first diffuser, the second rim is disposed at a first axial end of the second diffuser, the second diffuser further comprises a fourth rim disposed at a second axial end of the second diffuser, the third rim is identical to the second rim, and the fourth rim is identical to the first rim.

17. A method of lifting fluid in a wellbore, comprising:

running an electric submersible pump into a wellbore, wherein the electric submersible pump comprises the diffuser stack of claim 1, an impeller coupled to the diffuser stack, a shaft rotationally coupled to the impeller, and a motor mechanically coupled to the shaft; and providing electric power to the motor to drive the shaft to rotate the impeller to induce flow through the diffuser stack.

18. A method of moving hydrocarbons through a horizontal pipe, comprising:

placing a centrifugal pump in fluid communication with a pipe, wherein the centrifugal pump comprises the diffuser stack of claim 1, an impeller coupled to the diffuser stack, a shaft rotationally coupled to the impeller, and a motor mechanically coupled to the shaft; and providing electric power to the motor to drive the shaft to rotate the impeller to induce flow through the diffuser stack.

19. A method of manufacturing a diffuser for a centrifugal pump, comprising:

casting a diffuser such that the diffuser comprises a first rim comprising a first inner circumferential surface and a first outer circumferential surface, and protrusions extending radially inward from the first inner circumferential surface, wherein the casting of the diffuser results in first areas of the first inner circumferential surface between the protrusions collectively having a first diameter, and second areas of the first inner circumferential surface between the first areas collectively having a second diameter that is less than the first diameter; and machining the diffuser, wherein the machining of the diffuser results in the second areas collectively having a third diameter that is greater than the second diameter and less than the first diameter, and wherein the protrusions extend radially inward beyond the third diameter.

20. The method of claim 19, wherein the casting of the diffuser comprises casting the diffuser such that the diffuser further comprises a first lip extending radially inward from the first inner circumferential surface, such that the protrusions further extend axially outward from the first lip, such that the first areas are disposed between the first lip and an axial end of the first rim, and such that the second areas are disposed between the protrusions and the axial end of the first rim.

21. The method of claim 19, wherein the casting of the diffuser further comprises:

casting the diffuser such that the diffuser comprises a second rim comprising a second inner circumferential surface and a second outer circumferential surface, and such that recesses are formed in the diffuser that extend radially inward from the second outer circumferential surface, wherein the casting of the diffuser results in the second outer circumferential surface having a fourth diameter.

22. A method of manufacturing a diffuser stack for a centrifugal pump, comprising:

manufacturing a first diffuser according to the method of claim 19;

casting a second diffuser such that the second diffuser comprises a second rim comprising a second inner circumferential surface and a second outer circumferential surface, and such that recesses are formed in the second diffuser that extend radially inward from the second outer circumferential surface, wherein the casting of the second diffuser results in the second outer circumferential surface having a fourth diameter;

machining the second diffuser, wherein the machining of the second diffuser results in the second outer circumferential surface having a fifth diameter that is less than the fourth diameter; and assembling the first diffuser and the second diffuser by inserting the protrusions into the recesses to create a diffuser stack.

23. The method of claim 22, wherein a diameter of the first outer circumferential surface and a diameter of the second outer circumferential surface are each greater than two inches and less than fifteen inches.

24. A method of assembling a centrifugal pump, comprising:

manufacturing a diffuser stack according to the method of claim 22;

coupling the diffuser stack to an impeller;

rotationally coupling the impeller to a drive shaft; and mechanically coupling the drive shaft to an electric motor.

25. The method of claim 19, wherein the second areas are disposed axially outward of the protrusions.

26. A method of manufacturing a diffuser for a centrifugal pump, comprising:

casting a first diffuser such that the first diffuser comprises a first rim comprising a first inner circumferential surface and a first outer circumferential surface, and such that recesses are formed in the first diffuser that extend radially inward from the first outer circumferential surface, wherein the casting of the first diffuser results in the first outer circumferential surface having a first diameter; and machining the first diffuser, wherein the machining of the first diffuser results in areas of the first outer circumferential surface between recesses having a second diameter that is less than the first diameter, wherein each cast recess extends radially inward beyond the second diameter.

27. A method of manufacturing a diffuser stack for a centrifugal pump, comprising:

manufacturing a first diffuser according to the method of claim 26;

casting a second diffuser such that the second diffuser comprises a second rim comprising a second inner circumferential surface and a second outer circumferential surface, and protrusions extending radially inward from the second inner circumferential surface, wherein the casting of the second diffuser results in first areas of the second inner circumferential surface between the protrusions collectively having a third diameter, and second areas of the second inner circumferential surface between the first areas collectively having a fourth diameter that is less than the third diameter;

machining the second diffuser, wherein the machining of the second diffuser results in the second areas collectively having a fifth diameter that is greater than the fourth diameter and less than the third diameter; and assembling the second diffuser and the first diffuser by inserting the protrusions into the recesses such that the first outer circumferential surface engages the second inner circumferential surface to create a diffuser stack.

* * * * *